US011432084B2

(12) United States Patent
Bergs et al.

(10) Patent No.: US 11,432,084 B2
(45) Date of Patent: Aug. 30, 2022

(54) PASSIVE INTEGRITY MANAGEMENT OF AN IMPLANTABLE DEVICE

(71) Applicant: Cochlear Limited, Macquarie University (AU)

(72) Inventors: Tommy Bergs, Mölnlycke (SE); Marcus Vardfjäll, Mölnlycke (SE); Kristian Gunnar Asnes, Mölnlycke (SE)

(73) Assignee: Cochlear Limited, Macquarie University (AU)

( * ) Notice: Subject to any disclaimer, the term of this patent is extended or adjusted under 35 U.S.C. 154(b) by 1431 days.

(21) Appl. No.: 15/336,910

(22) Filed: Oct. 28, 2016

(65) Prior Publication Data

US 2018/0124530 A1 May 3, 2018

(51) Int. Cl.

| | |
|---|---|
| ***H04R 25/00*** | (2006.01) |
| ***H04R 17/00*** | (2006.01) |
| ***H04R 23/02*** | (2006.01) |

(52) U.S. Cl.

CPC ..... *H04R 25/606* (2013.01); *H04R 17/005* (2013.01); *H04R 23/02* (2013.01); *H04R 2217/01* (2013.01); *H04R 2460/13* (2013.01)

(58) Field of Classification Search

CPC .... H04R 25/60; H04R 25/604; H04R 25/606; H04R 2460/13; H04R 17/00; H04R 17/005

See application file for complete search history.

(56) References Cited

U.S. PATENT DOCUMENTS

| | | | |
|---|---|---|---|
| 2,808,522 | A | 10/1957 | Aldraneiz |
| 4,498,461 | A | 2/1985 | Hakansson |
| 5,176,620 | A | 1/1993 | Gilman |
| 5,702,342 | A | 12/1997 | Metzler et al. |
| 5,772,575 | A | 6/1998 | Lesinski et al. |
| 5,800,336 | A | 9/1998 | Ball et al. |
| 5,815,872 | A | 10/1998 | Meginniss, III et al. |
| 6,005,955 | A | 12/1999 | Kroll et al. |
| 6,390,970 | B1 | 5/2002 | Müller |
| 6,438,243 | B1 | 8/2002 | Ikeuchi et al. |
| 6,447,295 | B1 | 9/2002 | Kumar et al. |
| 6,473,651 | B1 | 10/2002 | Kuzma et al. |
| 6,726,618 | B2 | 4/2004 | Miller |

(Continued)

FOREIGN PATENT DOCUMENTS

| | | | |
|---|---|---|---|
| EP | 1501074 | A2 | 1/2005 |
| KR | 20090079527 | A | 7/2009 |
| WO | 9855049 | A1 | 12/1998 |

OTHER PUBLICATIONS

Musil Technology, "MED-4901 Liquid Silicone Rubber," Life Sciences, May 16, 2014.

(Continued)

*Primary Examiner* — Carrie R Dorna

(74) *Attorney, Agent, or Firm* — Pilloff Passino & Cosenza LLP; Martin J. Cosenza

(57) ABSTRACT

A medical device prosthesis, including a housing and a piezoelectric transducer including a piezoelectric component, wherein the piezoelectric transducer is supported in the housing via at least one spring. In some embodiments, the medical device prosthesis is a bone conduction device, such as a transcutaneous passive or active bone conduction device.

31 Claims, 27 Drawing Sheets

(56) References Cited

U.S. PATENT DOCUMENTS

| | | | | |
|---|---|---|---|---|
| 6,759,790 | B1 | 7/2004 | Bugel et al. | |
| 7,065,223 | B2 | 6/2006 | Westerkull | |
| 7,180,225 | B2 | 2/2007 | Sashida et al. | |
| 7,242,786 | B2 | 7/2007 | Åsnes | |
| 7,247,976 | B2 | 7/2007 | Sashida et al. | |
| 7,840,020 | B1 | 11/2010 | Miller et al. | |
| 8,761,416 | B2 | 6/2014 | Hakansson | |
| 9,271,092 | B2 | 2/2016 | Bjorn et al. | |
| 9,554,222 | B2 | 1/2017 | Miller et al. | |
| 2003/0012390 | A1 | 1/2003 | Franks | |
| 2003/0055311 | A1 | 3/2003 | Neukermans et al. | |
| 2003/0124491 | A1 | 7/2003 | Honkura et al. | |
| 2004/0097785 | A1 | 5/2004 | Schmid et al. | |
| 2004/0148025 | A1 | 7/2004 | Schneider et al. | |
| 2005/0014108 | A1 | 1/2005 | Wohrle et al. | |
| 2005/0215852 | A1 | 9/2005 | Hatami | |
| 2005/0281432 | A1 | 12/2005 | Horigome | |
| 2006/0045298 | A1 | 3/2006 | Westerkull | |
| 2006/0058573 | A1 | 3/2006 | Neisz et al. | |
| 2006/0087203 | A1* | 4/2006 | Cho | H04R 25/606 310/353 |
| 2006/0281963 | A1 | 12/2006 | Easter et al. | |
| 2007/0041595 | A1 | 2/2007 | Carazo et al. | |
| 2007/0104344 | A1 | 5/2007 | Goldberg | |
| 2007/0156011 | A1* | 7/2007 | Westerkull | H04R 25/554 600/25 |
| 2008/0075319 | A1 | 3/2008 | Kantor et al. | |
| 2008/0112584 | A1 | 5/2008 | Karamuk | |
| 2008/0188707 | A1 | 8/2008 | Bernard et al. | |
| 2009/0082817 | A1 | 3/2009 | Jinton et al. | |
| 2009/0115294 | A1 | 5/2009 | Kikushima | |
| 2009/0124849 | A1 | 5/2009 | Pergola | |
| 2009/0245555 | A1 | 10/2009 | Parker et al. | |
| 2010/0298626 | A1 | 11/2010 | Andersson et al. | |
| 2011/0268303 | A1 | 11/2011 | Ahsani | |
| 2012/0108887 | A1 | 5/2012 | Vermeiren | |
| 2013/0184629 | A1 | 7/2013 | Gurtner et al. | |
| 2013/0197298 | A1 | 8/2013 | Miller et al. | |
| 2014/0112503 | A1 | 4/2014 | Hebenstreit | |
| 2014/0163308 | A1 | 6/2014 | Miller et al. | |
| 2014/0303688 | A1 | 10/2014 | Kulah et al. | |
| 2015/0141740 | A1 | 5/2015 | Miller | |
| 2015/0156594 | A1 | 6/2015 | Bervoets | |
| 2016/0037273 | A1 | 2/2016 | Gustafsson | |

OTHER PUBLICATIONS

International Search Report and Written Opinion for PCT/IB2017/056571, dated Feb. 19, 2018.

* cited by examiner

PASSIVE INTEGRITY MANAGEMENT OF AN IMPLANTABLE DEVICE

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc., or for individuals who suffer from stuttering problems.

SUMMARY

In accordance with one aspect, there is a prosthetic medical device, comprising: a housing; and a piezoelectric component, wherein the piezoelectric component is supported in the housing via at least one spring.

In accordance with another aspect, there is a component of a bone conduction device, comprising: a housing; and a transducer-seismic mass assembly, wherein the component is configured to enable permanent shock-proofing of the assembly beyond that which results from damping.

In accordance with another aspect, there is a component of a transcutaneous bone conduction device, comprising: a housing; and a transducer-seismic mass assembly including a piezoelectric component, wherein the transducer-seismic mass assembly of the transcutaneous bone conduction device is configured to translate in its entirety within the when the housing is closed.

In accordance with another aspect, there is a method, comprising: obtaining a component of a medical device prosthesis including a piezoelectric bender; operating the component in a first mechanical state such that the piezoelectric bender bends in a manner that at least one of consumes or generates electricity, wherein the component is configured to experience an acceleration of 100 Gs in the first mechanical state in both directions normal to a plane of extension of the piezoelectric bender and subsequently operate in the first mechanical state.

BRIEF DESCRIPTION OF THE DRAWINGS

Some embodiments are described below with reference to the attached drawings, in which.

DETAILED DESCRIPTION

Figure 1:
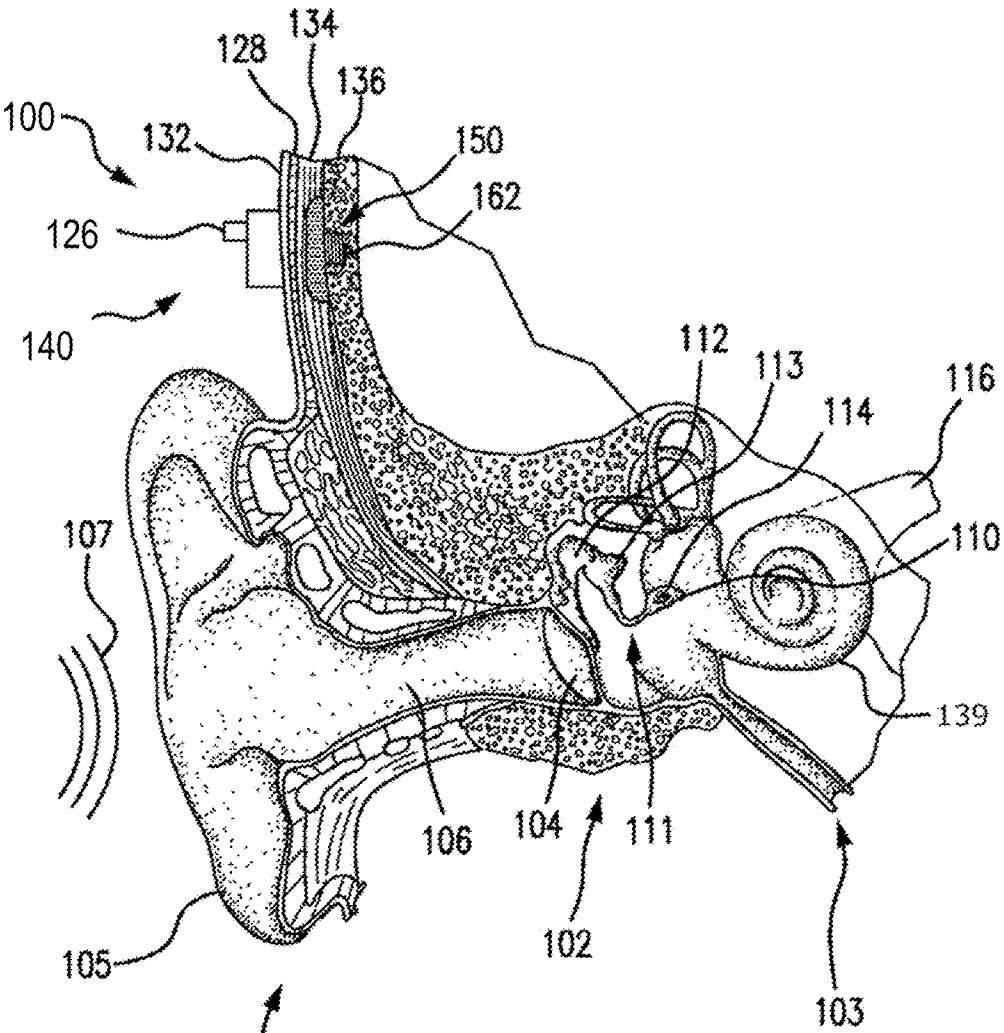
FIG. 1 is a perspective view of an exemplary bone conduction device in which at least some embodiments can be implemented.

Embodiments herein are described primarily in terms of a bone conduction device, such as an active transcutaneous bone conduction device. However, it is noted that the teachings detailed herein and/or variations thereof are also applicable to a cochlear implant and/or a middle ear implant. Accordingly, any disclosure herein of teachings utilized with an active transcutaneous bone conduction device also corresponds to a disclosure of utilizing those teachings with respect to a cochlear implant and utilizing those teachings with respect to a middle ear implant. Moreover, at least some exemplary embodiments of the teachings detailed herein are also applicable to a passive transcutaneous bone conduction device. It is further noted that the teachings detailed herein can be applicable to other types of prostheses, such as by way of example only and not by way of limitation, a retinal implant. Indeed, the teachings detailed herein can be applicable to any component that is held against the body that utilizes an RF coil and/or an inductance coil or any type of communicative coil to communicate with a component implanted in the body. That said, the teachings detailed herein will be directed by way of example only and not by way of limitation towards a component that is held against the head of a recipient for purposes of the establishment of an external component of the hearing prosthesis. In view of this, FIG. 1 is a perspective view of a bone conduction device 100 in which embodiments may be implemented. As shown, the recipient has an outer ear 101, a middle ear 102, and an inner ear 103. Elements of outer ear 101, middle ear 102, and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 210 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102, and inner ear 103 of a recipient of device 100. Bone conduction device 100 comprises an external component 140 and implantable component 150. As shown, bone conduction device 100 is positioned behind outer ear 101 of the recipient and comprises a sound input element 126 to receive sound signals. Sound input element 126 may comprise, for example, a microphone. In an exemplary embodiment, sound input element 126 may be located, for example, on or in bone conduction device 100, or on a cable extending from bone conduction device 100.

More particularly, sound input device 126 (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

Alternatively, sound input element 126 may be subcutaneously implanted in the recipient, or positioned in the recipient's ear. Sound input element 126 may also be a component that receives an electronic signal indicative of sound, such as, for example, from an external audio device. For example, sound input element 126 may receive a sound signal in the form of an electrical signal from an MP3 player electronically connected to sound input element 126.

Bone conduction device 100 comprises a sound processor (not shown), an actuator (also not shown), and/or various other operational components. In operation, the sound processor converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with some embodiments, a fixation system 162 may be used to secure implantable component 150 to skull 136. As described below, fixation system 162 may be a bone screw fixed to skull 136, and also attached to implantable component 150.

In one arrangement of FIG. 1, bone conduction device 100 can be a passive transcutaneous bone conduction device. That is, no active components, such as the actuator, are implanted beneath the recipient's skin 132. In such an arrangement, the active actuator is located in external component 140, and implantable component 150 includes a magnetic plate, as will be discussed in greater detail below. The magnetic plate of the implantable component 150 vibrates in response to vibration transmitted through the skin, mechanically and/or via a magnetic field, that is generated by an external magnetic plate.

In another arrangement of FIG. 1, bone conduction device 100 can be an active transcutaneous bone conduction device where at least one active component, such as the actuator, is implanted beneath the recipient's skin 132 and is thus part of the implantable component 150. As described below, in such an arrangement, external component 140 may comprise a sound processor and transmitter, while implantable component 150 may comprise a signal receiver and/or various other electronic circuits/devices.

Figure 2:
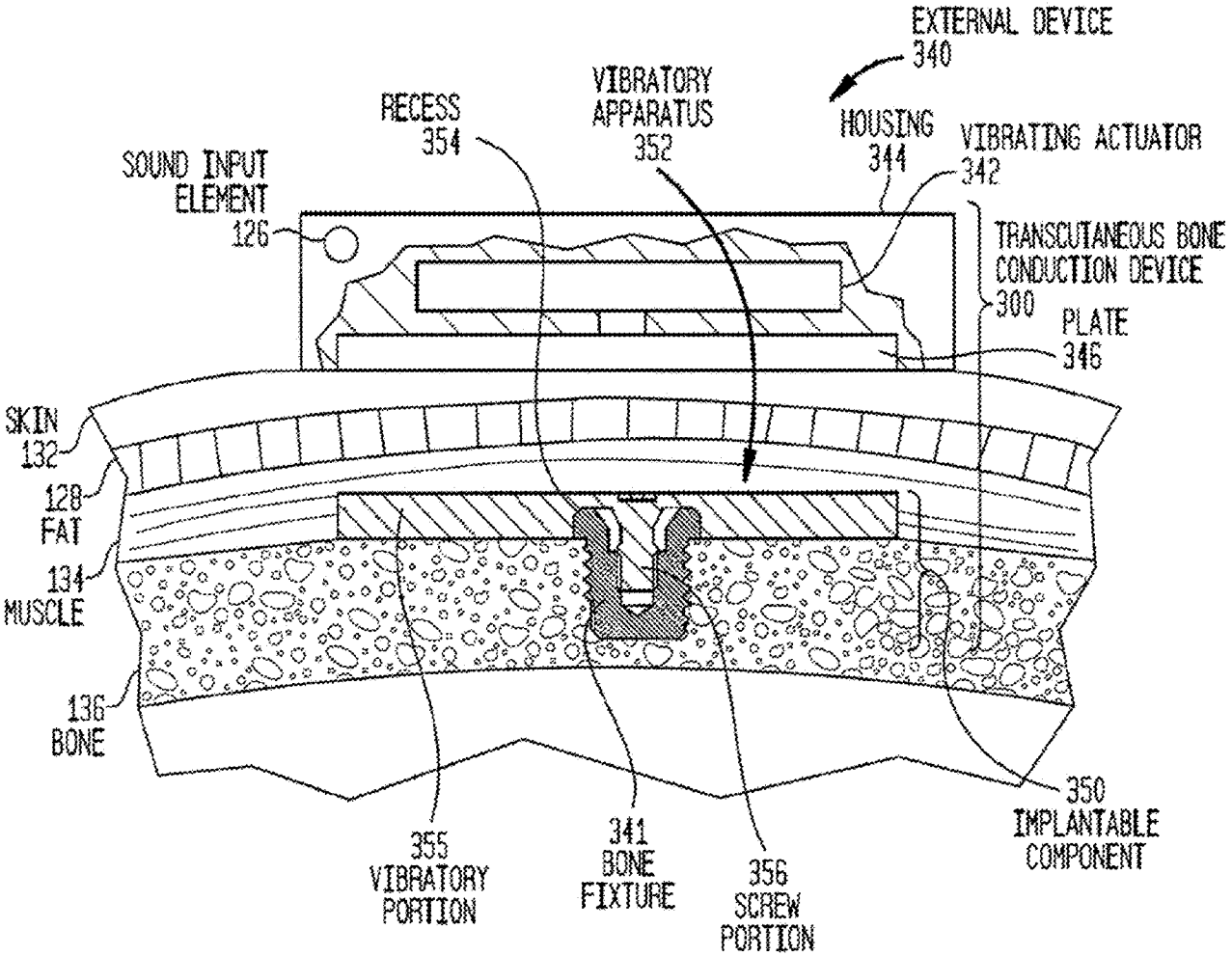
FIG. 2 is a schematic diagram conceptually illustrating a passive transcutaneous bone conduction device.

FIG. 2 depicts an exemplary transcutaneous bone conduction device 300 that includes an external device 340 (corresponding to, for example, element 140 of FIG. 1) and an implantable component 350 (corresponding to, for example, element 150 of FIG. 1). The transcutaneous bone conduction device 300 of FIG. 2 is a passive transcutaneous bone conduction device in that a vibrating electromagnetic actuator 342 is located in the external device 340. Vibrating electromagnetic actuator 342 is located in housing 344 of the external component, and is coupled to plate 346. Plate 346 may be in the form of a permanent magnet and/or in another form that generates and/or is reactive to a magnetic field, or otherwise permits the establishment of magnetic attraction between the external device 340 and the implantable component 350 sufficient to hold the external device 340 against the skin of the recipient.

In an exemplary embodiment, the vibrating electromagnetic actuator 342 is a device that converts electrical signals into vibration. In operation, sound input element 126 converts sound into electrical signals. Specifically, the transcutaneous bone conduction device 300 provides these electrical signals to vibrating electromagnetic actuator 342, or to a sound processor (not shown) that processes the electrical signals, and then provides those processed signals to vibrating electromagnetic actuator 342. The vibrating electromagnetic actuator 342 converts the electrical signals (processed or unprocessed) into vibrations. Because vibrating electromagnetic actuator 342 is mechanically coupled to plate 346, the vibrations are transferred from the vibrating electromagnetic actuator 342 to plate 346. Implanted plate assembly 352 is part of the implantable component 350, and is made of a ferromagnetic material that may be in the form of a permanent magnet, that generates and/or is reactive to a magnetic field, or otherwise permits the establishment of a magnetic attraction between the external device 340 and the implantable component 350 sufficient to hold the external device 340 against the skin of the recipient. Accordingly, vibrations produced by the vibrating electromagnetic actuator 342 of the external device 340 are transferred from plate 346 across the skin to plate 355 of plate assembly 352. This can be accomplished as a result of mechanical conduction of the vibrations through the skin, resulting from the external device 340 being in direct contact with the skin and/or from the magnetic field between the two plates. These vibrations are transferred without penetrating the skin with a solid object, such as an abutment, with respect to a percutaneous bone conduction device.

As may be seen, the implanted plate assembly 352 is substantially rigidly attached to a bone fixture 341 in this embodiment. Plate screw 356 is used to secure plate assembly 352 to bone fixture 341. The portions of plate screw 356 that interface with the bone fixture 341 substantially correspond to an abutment screw discussed in some additional detail below, thus permitting plate screw 356 to readily fit into an existing bone fixture used in a percutaneous bone conduction device. In an exemplary embodiment, plate screw 356 is configured so that the same tools and procedures that are used to install and/or remove an abutment screw (described below) from bone fixture 341 can be used to install and/or remove plate screw 356 from the bone fixture 341 (and thus the plate assembly 352).

Figure 3:
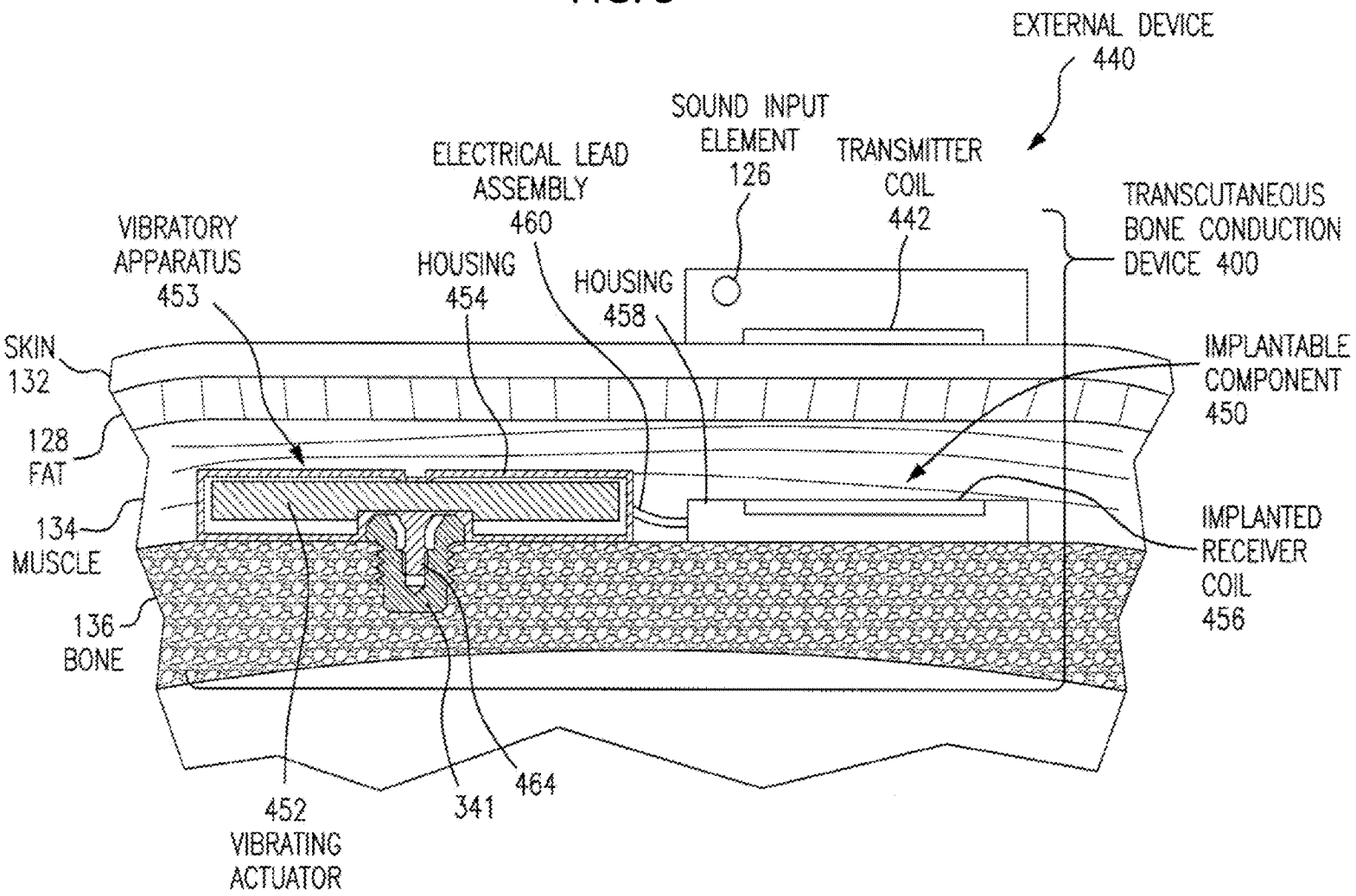
FIG. 3 is a schematic diagram conceptually illustrating an active transcutaneous bone conduction device in accordance with at least some exemplary embodiments.

FIG. 3 depicts an exemplary embodiment of a transcutaneous bone conduction device 400 according to another embodiment that includes an external device 440 (corresponding to, for example, element 140B of FIG. 1) and an implantable component 450 (corresponding to, for example, element 150 of FIG. 1). The transcutaneous bone conduction device 400 of FIG. 3 is an active transcutaneous bone conduction device in that the vibrating electromagnetic actuator 452 is located in the implantable component 450. Specifically, a vibratory element in the form of vibrating electromagnetic actuator 452 is located in housing 454 of the implantable component 450. In an exemplary embodiment, much like the vibrating electromagnetic actuator 342 described above with respect to transcutaneous bone conduction device 300, the vibrating electromagnetic actuator 452 is a device that converts electrical signals into vibration.

External component 440 includes a sound input element 126 that converts sound into electrical signals. Specifically, the transcutaneous bone conduction device 400 provides these electrical signals to vibrating electromagnetic actuator 452, or to a sound processor (not shown) that processes the electrical signals, and then provides those processed signals to the implantable component 450 through the skin of the recipient via a magnetic inductance link. In this regard, a transmitter coil 442 of the external component 440 transmits these signals to implanted receiver coil 456 located in housing 458 of the implantable component 450. Components (not shown) in the housing 458, such as, for example, a signal generator or an implanted sound processor, then generate electrical signals to be delivered to vibrating electromagnetic actuator 452 via electrical lead assembly 460. The vibrating electromagnetic actuator 452 converts the electrical signals into vibrations.

The vibrating electromagnetic actuator 452 is mechanically coupled to the housing 454. Housing 454 and vibrating electromagnetic actuator 452 collectively form a vibratory apparatus 453. The housing 454 is substantially rigidly attached to bone fixture 341.

Figure 4:
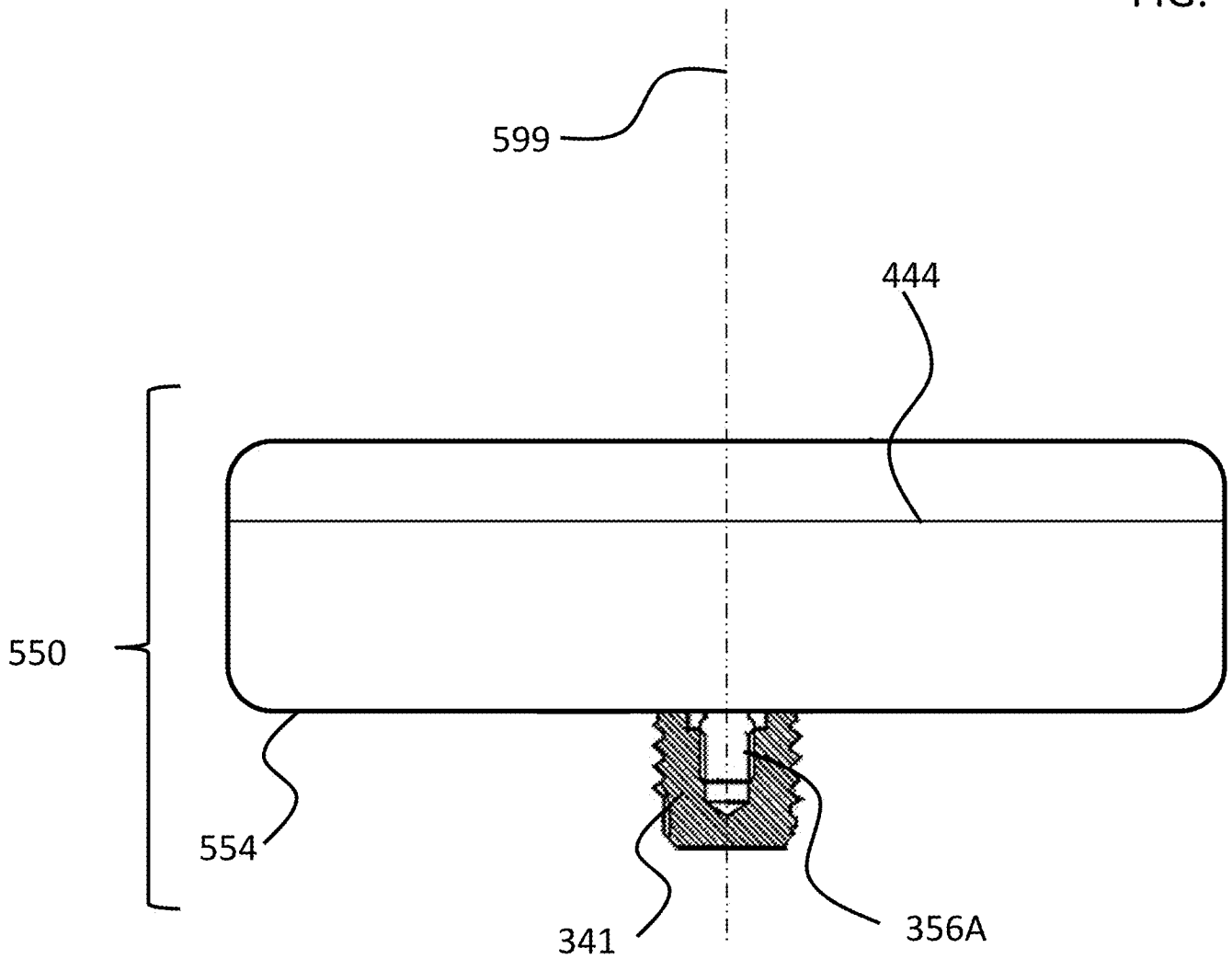
FIG. 4 is a schematic diagram of an outer portion of an implantable component of a bone conduction device.
Figure 5:
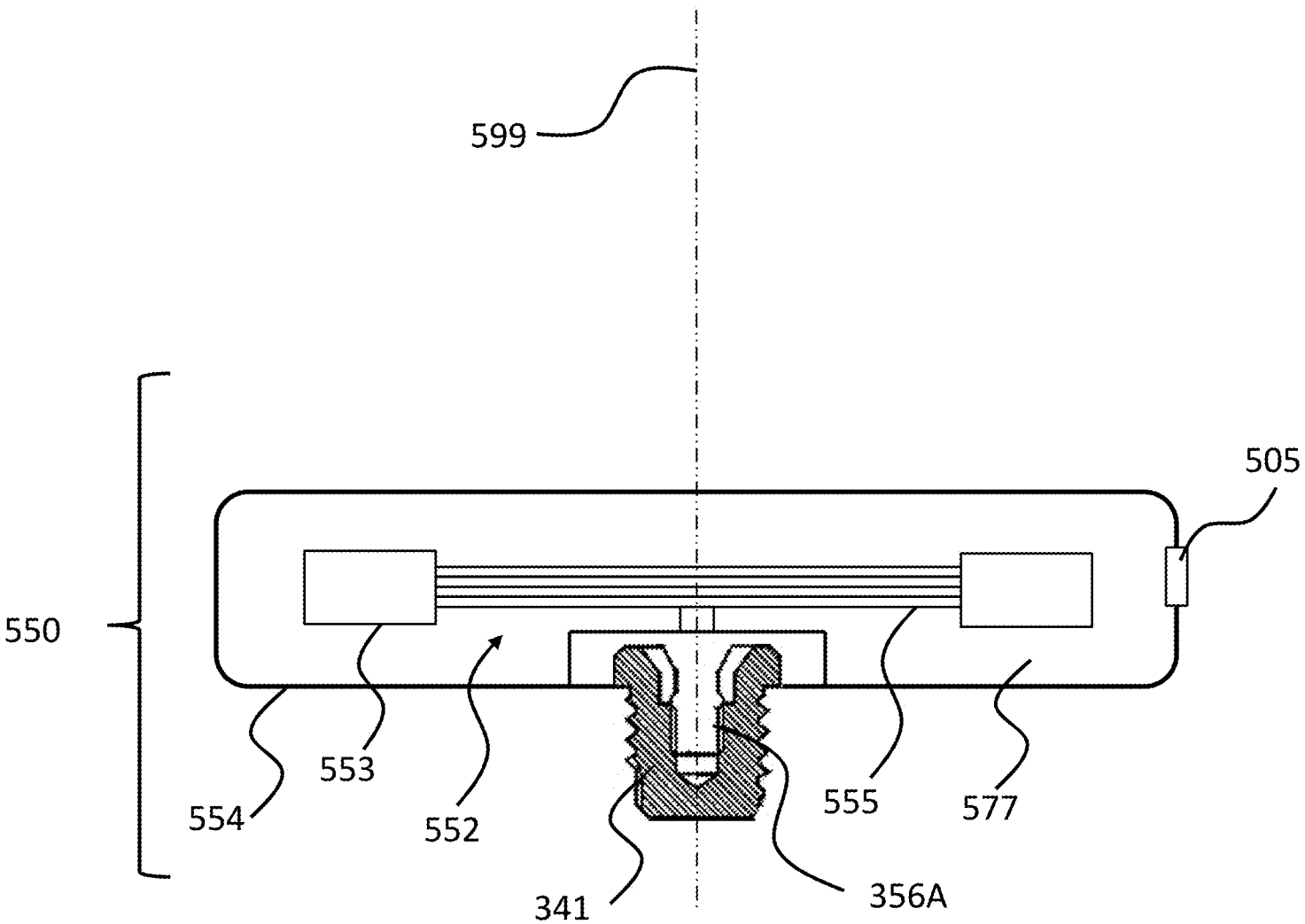
FIG. 5 is a schematic diagram of a cross-section of an exemplary implantable component of a bone conduction device.

FIGS. 4 and 5 depict another exemplary embodiment of an implantable component usable in an active transcutaneous bone conduction device, here, implantable component 550. FIG. 4 depicts a side view of the implantable component 550 which includes housing 554 which entails two housing bodies made of titanium in an exemplary embodiment, welded together at seam 444 to form a hermetically sealed housing. FIG. 5 depicts a cross-sectional view of the implantable component 550.

In an exemplary embodiment, the implantable component 550 is used in the embodiment of FIG. 3 in place of implantable component 450. As can be seen, implantable component 550 combines an actuator 552 (corresponding with respect to functionality to actuator 452 detailed above). Briefly, it is noted that the vibrating actuator 552 includes a so-called counterweight/mass 553 that is supported by piezoelectric components 555. In the exemplary embodiment of FIG. 5, the piezoelectric components 555 flex upon the exposure of an electrical current thereto, thus moving the counterweight 553. In an exemplary embodiment, this movement creates vibrations that are ultimately transferred to the recipient to evoke a hearing percept.

As can be understood from the schematic of FIG. 5, in an exemplary embodiment, the housing 554 entirely and completely encompasses the vibratory apparatus 552, but includes feedthrough 505, so as to permit the electrical lead assembly 460 to communicate with the vibrating actuator 452 therein. It is briefly noted at this time that some and/or all of the components of the embodiment of FIG. 5 are at least generally rotationally symmetric about the longitudinal axis 559. In this regard, the screw 356A is circular about the longitudinal axis 559. Back lines have been omitted for purposes of clarity in some instances.

Figure 6:
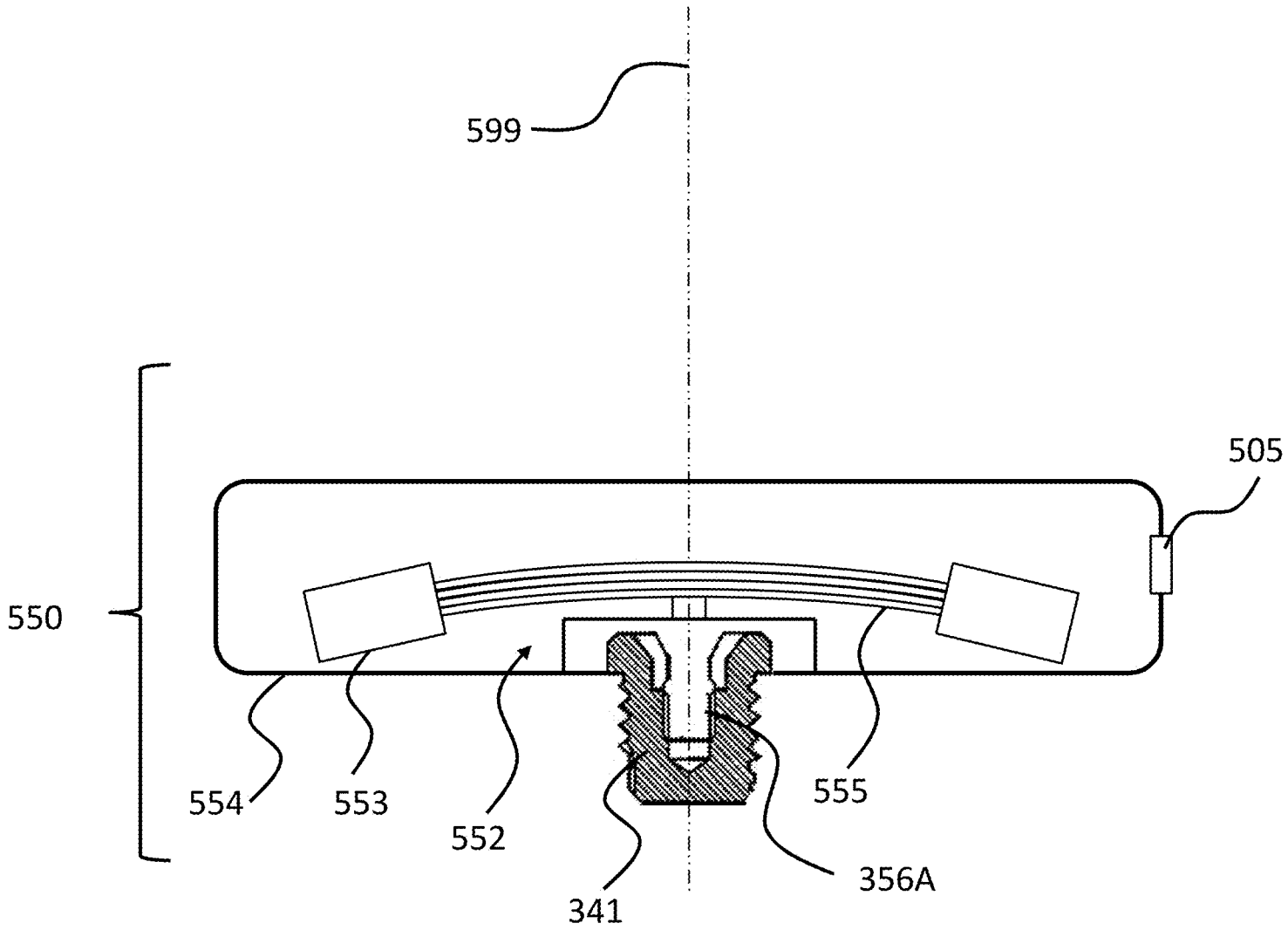
FIG. 6 is a schematic diagram of a cross-section of the exemplary implantable component of FIG. 5 in operation.

Still with reference to FIG. 5, as can be seen, there is a space 577 located between the housing 554 in general, and the inside wall thereof in particular, and the counterweight 553. This space has utilitarian value with respect to enabling the implantable component 550 to function as a transducer in that, in a scenario where the implantable component is an actuator, the piezoelectric material 555 can flex, which can enable the counterweight 553 to move within the housing 554 so as to generate vibrations to evoke a hearing percept. FIG. 6 depicts an exemplary scenario of movement of the piezoelectric material 555 when subjected to an electrical current along with the movement of the counterweight 553. As can be seen, space 577 provides for the movement of the actuator 552 within housing 554 so that the counterweight 553 does not come into contact with the inside wall of the housing 554. However, the inventors of the present application have identified a failure mode associated with such an implantable component 550. Specifically, in a scenario where prior to the attachment of the housing 554 and the components therein to the bone fixture 341, the housing and the components therein are subjected to an acceleration above certain amounts and/or a deceleration above certain amounts, the piezoelectric material 555 will be bent or otherwise deformed beyond its operational limits, which can, in some instances, have a deleterious effect on the piezoelectric material.

Figure 7:
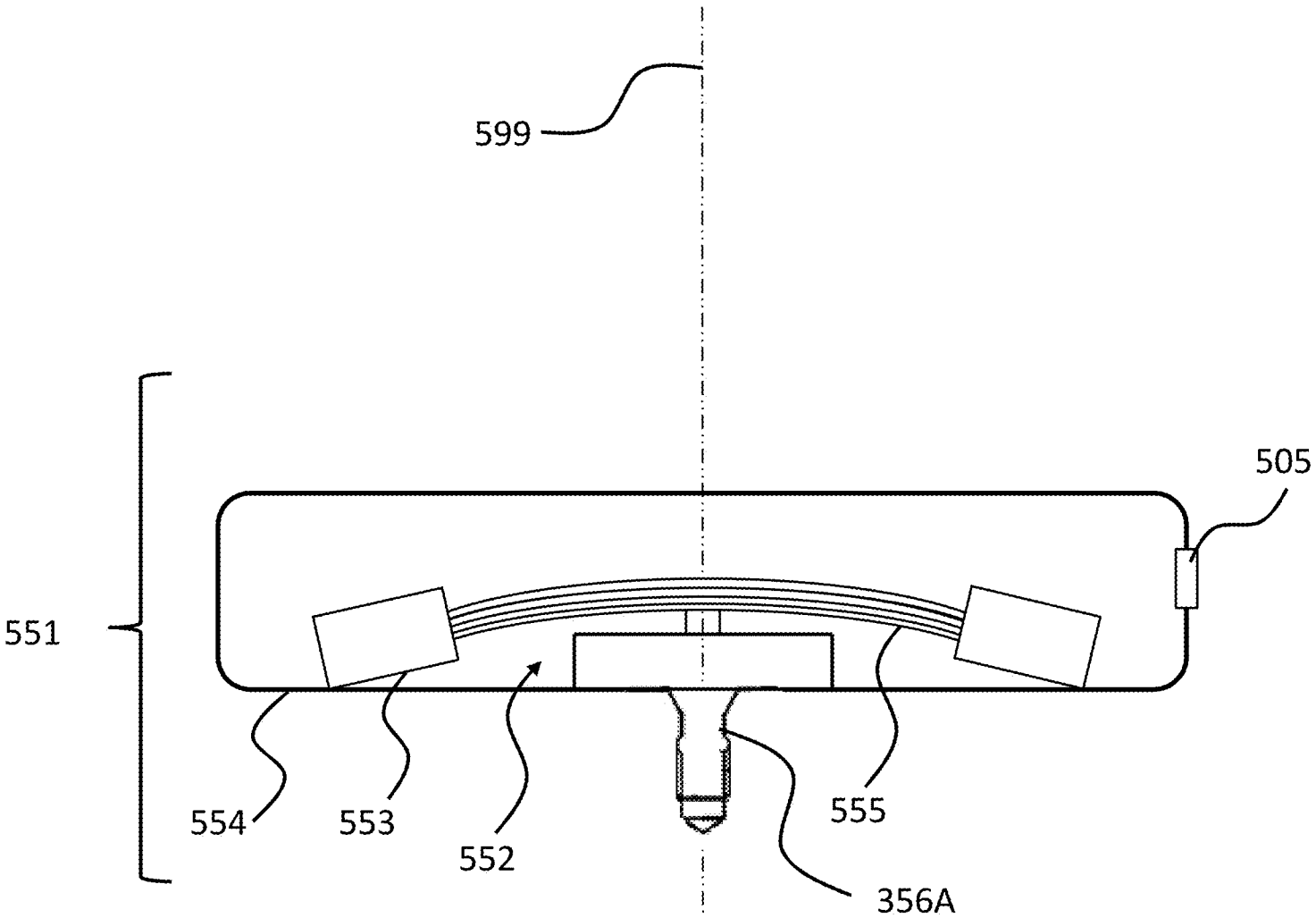
FIG. 7 is a schematic diagram of a cross-section of the exemplary implantable component of FIG. 5 in a failure mode.

FIG. 7 depicts an exemplary failure mode, where implantable sub component 551 (without bone fixture 541) prior to implantation into a recipient (and thus prior to attachment to the bone fixture 541) is dropped from a height of 1.25 m onto a standard operating room floor or the like. The resulting deceleration causes the piezoelectric material 555, which is connected to the counterweight 553, to deform as seen in FIG. 7. This can break or otherwise plastically deform the piezoelectric material 555 (irrespective of whether the counterweight 553 contacts the housing walls, in some embodiments—indeed, in many embodiments, the piezoelectric material 555 will fail prior to the counterweights contacting the walls—thus, FIG. 7 is presented for purposes of conceptual illustration). The teachings detailed herein are directed towards avoiding such a scenario when associated with such decelerations and/or accelerations.

Figure 8:
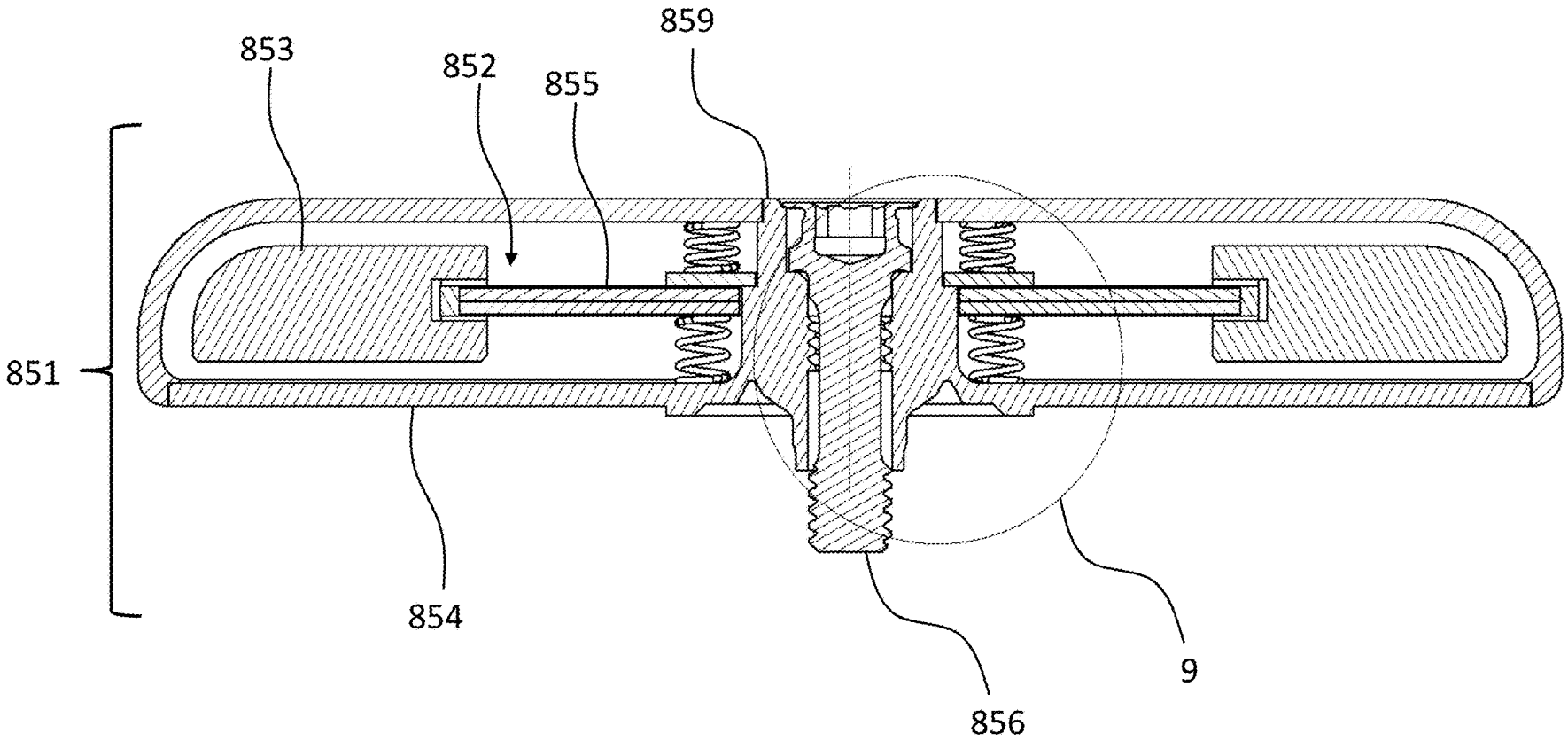
FIG. 8 is a schematic diagram of a cross-section of an exemplary embodiment that prevents the failure mode conceptually represented in FIG. 7.

FIG. 8 depicts an exemplary embodiment of an exemplary implantable sub component 851 having utilitarian value in that such can reduce or otherwise eliminate the failure mode associated with that depicted in FIG. 7. FIG. 8 depicts a cross-section through the geometric center of the subcomponent 851. Implantable subcomponent 851 includes a housing 854 that encases an actuator 852, which actuator includes a piezoelectric material 855 corresponding to material 555 of FIG. 7, and a counterweight 853 that corresponds to the counterweight 553 of FIG. 7. Also seen in FIG. 8 is that the housing 854 includes a core 859. In this exemplary embodiment, the core 859 is an integral part with the bottom of the housing. The core 859 has a passage through which screw 856 extends, which screw is configured to screw into the bone fixture implanted into the bone of the recipient so as to fix the implantable subcomponent 851 to bone of the recipient. In this exemplary embodiment, the core 859 is such that the screw 856 can extend therethrough while maintaining a hermetically sealed environment within the housing (e.g., the housing subcomponent that forms the top of the housing 854 can be laser welded at the seams with the housing subcomponent that forms the bottom of the housing 854 and the core 859).

Figure 9:
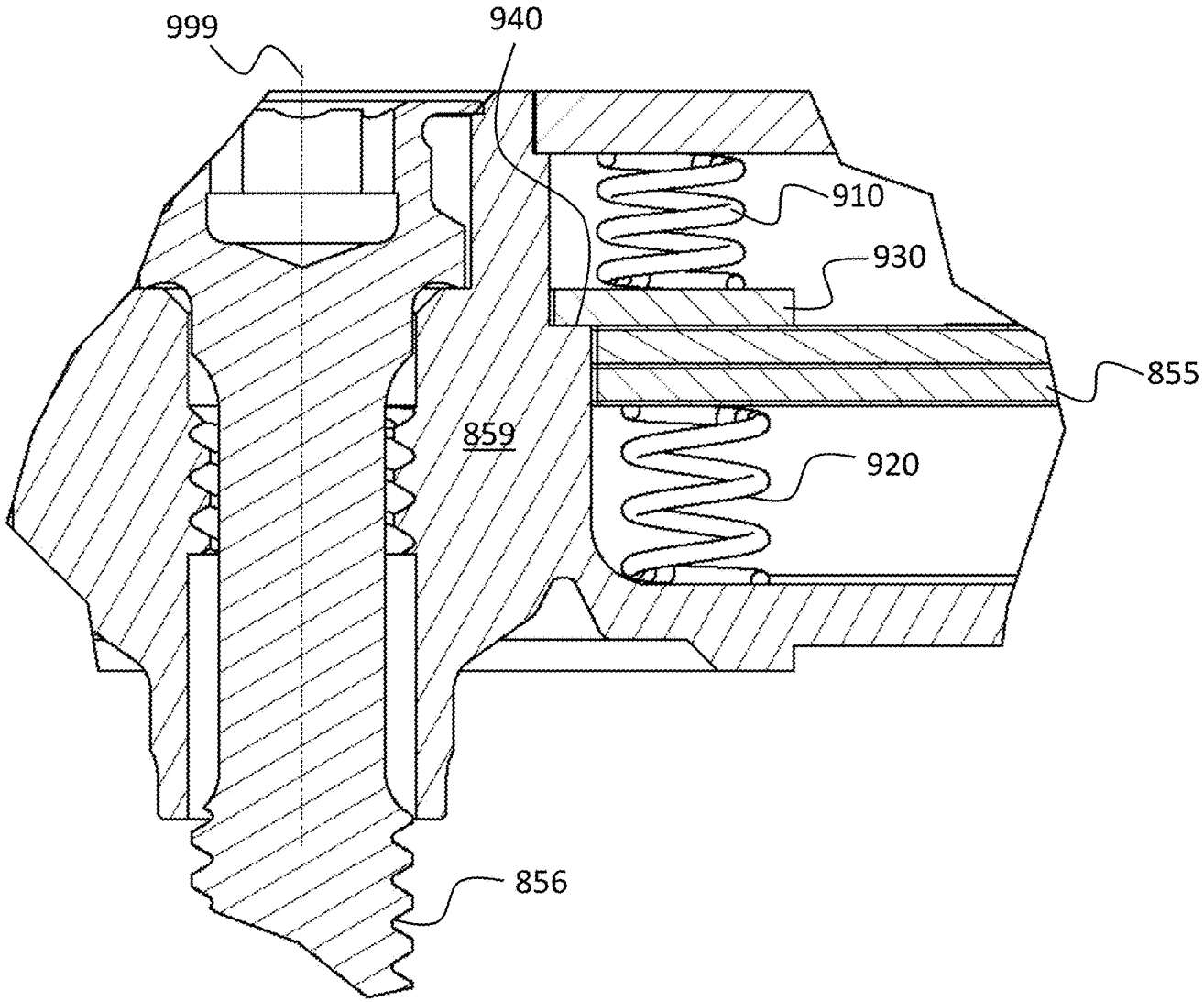
FIG. 9 is a schematic diagram of a portion of the cross-section of the exemplary embodiment depicted in FIG. 8.

FIG. 9 depicts a larger view of a portion of the embodiment of FIG. 8. As can be seen, the piezoelectric material 855 is coated with a coating, thereby establishing the piezoelectric component. In some alternate embodiments, the piezoelectric material has no coating. Hereinafter, any use of the phrase piezoelectric material corresponds to a disclosure of piezoelectric material with coating, and thus a disclosure of a piezoelectric component, as well as a disclosure of a piezoelectric material without a coating (which still can be a piezoelectric component—there is just no coating), unless otherwise specified. The piezoelectric component 855 is clamped between two springs 910 and 920. A washer 930 is interposed between the top spring 910 and the piezoelectric material 855. Thus, the clamping of the piezoelectric component is in part, indirect by the springs. Where there is a washer at the bottom, as is the case in some embodiments, the clamping would be totally indirect by the springs, whereas in some exemplary embodiments, where there is no washer 930, and the springs directly contact the piezoelectric component, the clamping is totally direct. It is briefly noted that in some exemplary embodiments, a portion of the piezoelectric component 855 located proximate the core 859 does not bend or otherwise flex or otherwise actuate when electricity is supplied thereto. In this regard, the piezoelectric component 855 is configured such that the bending portion is located beyond/outboard the outer boundaries of the washer 930. In an exemplary embodiment, as measured from the longitudinal axis of the implantable subcomponent 999, more than or less than 10%, 15%, 20%, 25%, 30%, 35%, 40%, 45%, 50%, 55%, 60%, 65%, 70%, 75%, 80% or more, or any value or range of values therebetween in 0.1% increments (22.3% to 34.2%, 25.7%, etc.) of the distance to the end of the piezoelectric component 855 (the most outboard portion) is a portion that does not bend or flex or move when exposed to electricity. It is noted that the phrase piezoelectric component as used herein includes both the portion that flexes or otherwise moves when exposed to electricity, as well as the portion thereof that does not flex or otherwise move when exposed to electricity.

In an exemplary embodiment, as will be described in greater detail below, the springs 910 and 920 provide shock-proofing to the implantable subcomponent 851. As will be described in greater detail below, the springs permit the entire piezoelectric component 855 to move upwards and/or downwards when subjected to a high acceleration and/or a high deceleration. This is as opposed to the scenario where only a portion of the piezoelectric component moves when exposed to these high accelerations. In this regard, the combination of the piezoelectric component and the counterweight creates a transducer-seismic mass assembly. In an exemplary embodiment, the springs permit the entire transducer-seismic mass assembly to move upwards and/or downwards when subjected to a high acceleration and/or a high deceleration. Again, this is as opposed to a scenario where only a portion of that transducer-seismic mass assembly moves.

Hereinafter, the configuration utilizing apparatuses to allow the piezoelectric component to move when subjected to an acceleration and/or deceleration is sometimes referred to herein for purposes of linguistic economy as a shock-proof assembly.

While the springs 910 and 920 have been depicted as coil springs, as will be seen below, in some exemplary embodiments, other types of springs can be utilized, such as leaf springs and Belleville springs.

Figure 10:
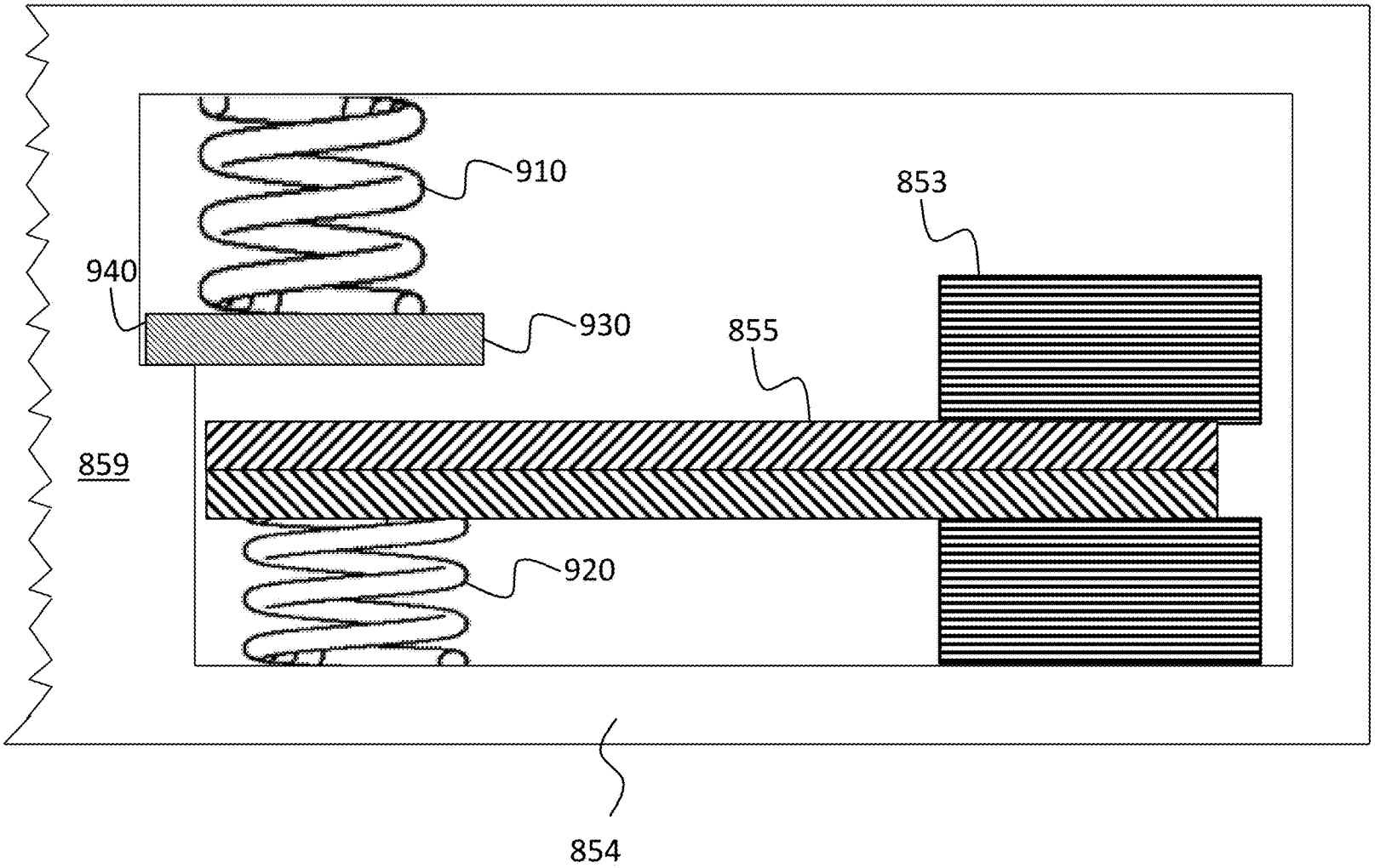
FIG. 10-14B are schematic diagrams depicting features of the embodiment of FIG. 7 and variations thereof.

FIG. 10 depicts an exemplary principle of operation of the shock-proof assembly of the embodiment of FIG. 8, in somewhat functional/black box schematic. As can be seen, in this exemplary embodiment, the transducer-seismic mass assembly in general, and the piezoelectric component 855 in particular, has moved from the position present in the state depicted in FIGS. 8 and 9 to the state depicted in FIG. 10. In an exemplary embodiment, the state depicted in FIGS. 8 and 9 are referred to herein as the first mechanical state of the implantable subcomponent, and the state depicted in FIG. 10 is referred to herein as the second mechanical state of the implantable subcomponent. With respect to FIG. 10, in this exemplary embodiment, the implantable subcomponent has been subjected to an upward acceleration or a downward deceleration (upward acceleration means that it has a velocity component upward which is increasing per second, and downward deceleration means that it has a velocity component downward which is decreasing per second). By way of example only and not by way of limitation, the second mechanical state depicted in FIG. 10 can be that which exists when the implantable subcomponent is dropped from a height of one meter or so in a one G environment at the time that it contacts a concrete floor or the like. In this regard, the bottom of the housing 854 will strike the floor, and thus will stop further movement of the housing downwards towards the center of the earth. This will stop suddenly, as concrete tends to be a material that has poor shock absorption properties. The resulting deceleration could be 10, 20, 30, 40, 50, 60, 70, 80, 90, 100, 125, 150, 175, 200, 225, 250, 275, 300, 350, 400, 450, or 500 or more Gs. By way of example only and not by way of limitation, with respect to a 5, 6, 7, 8, 9, 10, 11, 12, 13, 14, 15 or more gram counterweight 853, 10, 11, 12, 13, 14, 15, 16, 17, 18, 19, 20, 21, 22, 23, 24, 25, 26, 27, 28, 29 or 30 or more Newtons of downward force could be experienced at the center of mass of the counterweight 853, and thus the outer ends of the piezoelectric component 855. In a scenario where the piezoelectric component 855 was hard or rigidly mounted to the core 859, this could be bad. In this regard, the failure mode detailed above with respect to the piezoelectric material bending as seen in FIG. 7 could occur. This could break the relatively brittle piezoelectric material and/or plastically deform the piezoelectric material. This can be considered to be not as utilitarian as that which would be the case if the piezoelectric material did not break.

However, because the piezoelectric component 855 is not hard mounted or rigidly mounted to the core 859, or hard mounted or rigidly mounted directly or indirectly to the housing for that matter, but instead is mounted in a manner such that the piezoelectric component can move relative to the housing, the forces imparted on to the counterweight 853, which forces are transferred to the piezoelectric component 855, results in the piezoelectric component 855 moving downward upon those forces resulting in forces at the spring 920 being greater than the compression force of the spring in the first mechanical state of FIG. 8. In the embodiment depicted in FIG. 10, the spring constant of the spring 920 is such that the forces imparted onto spring 920 in the deceleration scenario just described above are sufficient to compress the spring as shown in a manner that results in the counterweight 853 striking the bottom of the housing 854. In this exemplary embodiment, this stops any substantial further motion of the piezoelectric component 855 (there can be some further movement of the inboard portions of the piezoelectric component 855 (e.g., most prominently, the portions of the piezoelectric component 855 that face the core 859, at least in some embodiments), owing to the fact that the inboard portions are still free to move downward, subject to the counterforce of the spring 920, but this downward movement is negligible with respect to preserving the structural integrity of the piezoelectric component 855).

As is to be understood from the figures, in an exemplary embodiment, the piezoelectric component 855 is free to move along the core 859. In an exemplary embodiment, the piezoelectric component 855 is slip fit around the core 859 (looking from above, the piezoelectric component 855 is in the form of a non-square rectangle with a hole at the geometric center thereof, through which the core 859 extends). In an exemplary embodiment, the piezoelectric material 855 is offset from the core 859. In an exemplary embodiment, this offset can be about 0.05 mm, 0.075 mm, 0.1 mm, 0.15 mm, 0.2 mm, 0.3 mm, 0.4 mm, 0.5 mm, 0.6 mm, 0.7 mm, 0.8 mm, 0.9 mm, 1.0 mm, 1.1 mm, 1.2 mm, 1.3 mm, 1.4 mm, or 1.5 mm (on any one side or all sides, can be an average space when taken about the circumference of the core 859, can be a total gap of the inner diameter of the hole through the piezoelectric component and the outer diameter of the core 859 when at the first mechanical state—all of these aforementioned values are in the first mechanical state—etc.) or any value or range of values therebetween in 0.001 mm increments. The point is, in an exemplary embodiment, the piezoelectric component 855 is configured to move relative to the housing 854 in general, and the core 859 in particular. It is also noted that in an exemplary embodiment, the aforementioned values can also be applicable to a bushing or the like that is interposed between the piezoelectric component 855 and the core 859. Any arrangement that will enable the piezoelectric component 855 to move according to the teachings detailed herein and/or variations thereof can be utilized in at least some exemplary embodiments.

Figure 11:
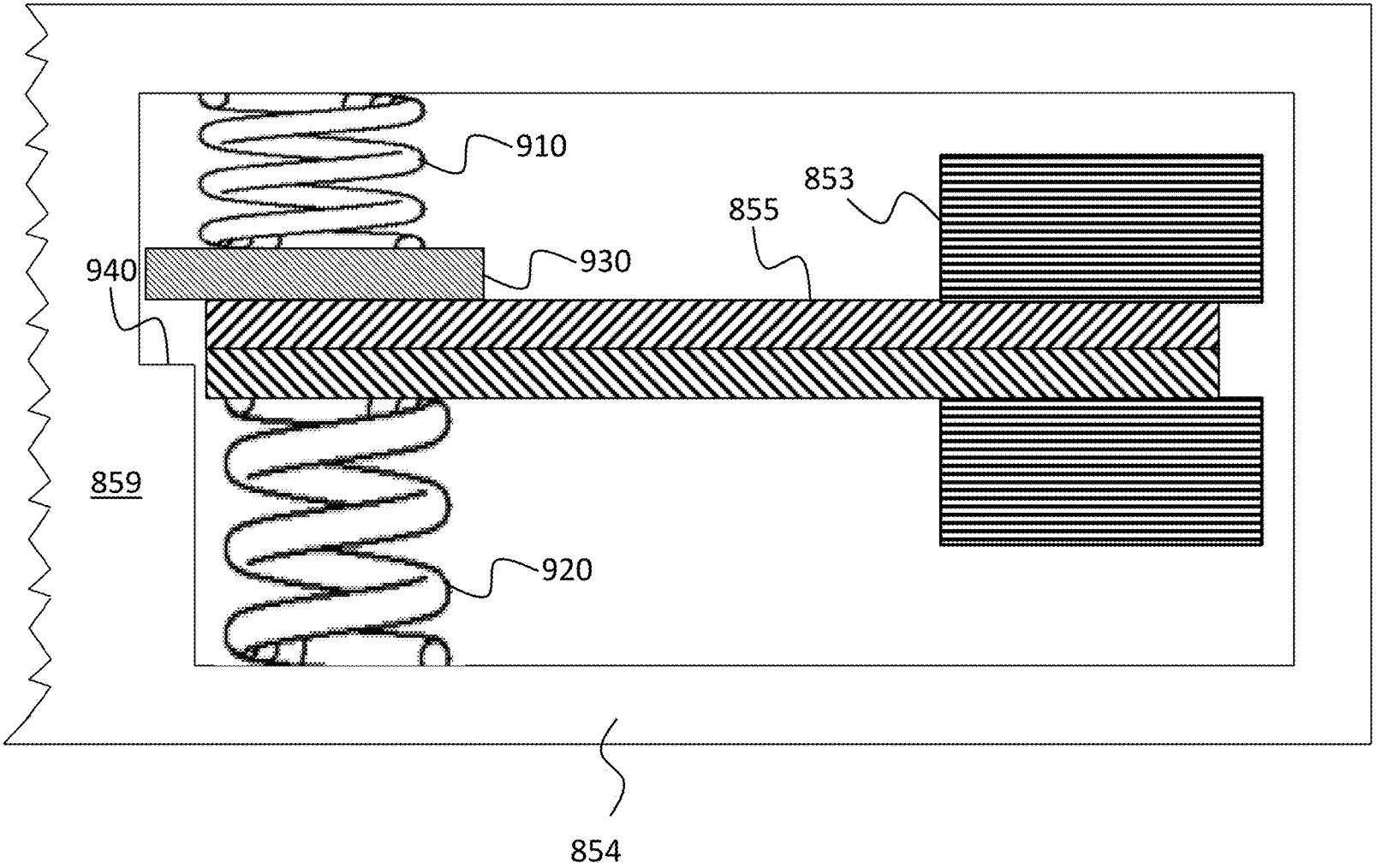

FIG. 11 depicts an exemplary principle of operation of the shock-proof assembly of the embodiment of FIG. 8, in somewhat functional/black box schematic. As can be seen, in this exemplary embodiment, the transducer-seismic mass assembly in general, and the piezoelectric component 855 in particular, has moved from the position present in the state depicted in FIGS. 8 and 9 to the state depicted in FIG. 11. In an exemplary embodiment, the state depicted in FIG. 11 is referred to herein as the third mechanical state of the implantable subcomponent. With respect to FIG. 11, in this exemplary embodiment, the implantable subcomponent has been subjected to a downward acceleration or an upward deceleration. By way of example only and not by way of limitation, the third mechanical state depicted in FIG. 11 can be that which exists when the implantable subcomponent is dropped upside down from a height of one meter or so in a one G environment at the time that it contacts a concrete floor or the like. In this regard, the top of the housing 854 will strike the floor, and thus will stop further movement of the housing downwards towards the center of the earth. This will stop suddenly, as concrete tends to be a material that has poor shock absorption properties. The resulting deceleration could be 10, 20, 30, 40, 50, 60, 70, 80, 90, 100, 125, 150, 175, 200, 225, 250, 275, 300, 350, 400, 450 or 500 or more Gs. By way of example only and not by way of limitation, with respect to a 5, 6, 7, 8, 9, 10, 11, 12, 13, 14, 15 or more gram counterweight 853, 10, 11, 12, 13, 14, 15, 16, 17, 18, 19, 20, 21, 22, 23, 24, 25, 26, 27, 28, 29 or 30 or more Newtons of downward force (relative to the implantable sub-component being upside down) could be experienced at the center of mass of the counterweight 853, and thus the outer ends of the piezoelectric component 855. In a scenario where the piezoelectric component 855 was hard or rigidly mounted to the core 859, this too could be bad, real bad. In this regard, the failure mode detailed above with respect to the piezoelectric material bending as seen in FIG. 7 could occur, albeit in the opposite direction. This could break the relatively brittle piezoelectric material and/or plastically deform the piezoelectric material. This can be considered to be not as utilitarian as that which will be the case if the piezoelectric material did not break.

However (and the following discussion will be directed, for simplicity, to a scenario where the implantable subcomponent is right side up, and somehow experiences an upward deceleration or a downward acceleration sufficient to move the transducer-counterweight assembly—in an exemplary scenario of the upward deceleration scenario could be a scenario associated with horseplay where the implantable component is thrown upwards and the top of the housing strikes a ceiling made of concrete—such an exemplary scenario could happen in a scenario where the teachings detailed herein are utilized for an external component of a passive transcutaneous bone conduction device, as will be described in greater detail below) because the piezoelectric component 855 is not hard mounted or rigidly mounted to the core 859, or hard mounted or rigidly mounted directly or indirectly to the housing for that matter, but instead is mounted in a manner such that the piezoelectric component can move relative to the housing, the forces imparted onto the counterweight 853, which forces are transferred to the piezoelectric component 855, results in the piezoelectric component 855 moving upward upon those forces resulting in forces at the spring 910 being greater than the compression force of the spring in the first mechanical state of FIG. 8. In the embodiment depicted in FIG. 11, the spring constant of the spring 910 is such that the forces imparted onto spring 910 in the deceleration scenario (an upward velocity component that reduces per second) sufficient to compress the spring 910 as shown in a manner that results in the counterweight 853 moving upwards with the entire piezoelectric component 855, thus preventing the over stressing of the piezoelectric component that could result in the failure mode detailed above.

The embodiment of FIG. 11 depicts the counterweight 853 stopping or otherwise halting with respect to upward movement relative to the housing prior to contacting the housing 854. Accordingly, it is noted that in at least some exemplary embodiments, utilitarian shock-proof features detailed herein can be utilized without the counterweight 853 striking the housing 854. That said, it is to be understood that in at least some exemplary embodiments, there can be a deceleration and/or an acceleration scenario where the counterweight 853 strikes the inside of the housing 854, thus further compressing spring 910 beyond that which is depicted in FIG. 11. As will be understood from the relative locations of the components of FIG. 11, it can be seen that the bottom of the piezoelectric component 855 would rise above the shoulder 940. In an exemplary embodiment, this could induce another type of failure mode in that the piezoelectric component 855 could get hung up on the shoulder 940, thus preventing the piezoelectric component 855 from returning to the first mechanical state of FIGS. 8 and 9. Accordingly, in an exemplary embodiment, stops 1254 can be included as part of the housing 854 (e.g. dimples formed in the upper and/or lower shell), as is depicted by way of example only and not by way of limitation, in FIG. 12. Such exemplary stops 1254 would stop further upward movement of the counterweight 853. Thus, in a scenario where sufficient upward deceleration exists, there can be a scenario that results in the counterweight 853 striking stops 1254, and thus housing 854 when stops 1254 are an integral part thereof. In this exemplary embodiment, this stops any substantial further motion of the piezoelectric component 855 (there will be some further movement of the inboard portions of the piezoelectric component 855 (e.g., most prominently, the portions of the piezoelectric component 855 that face the core 859, at least in some embodiments), owing to the fact that the inboard portions are still free to move upward, subject to the counterforce of the spring 910, but this upward movement is negligible with respect to preserving the structural integrity of the piezoelectric component 855).

Figure 12:
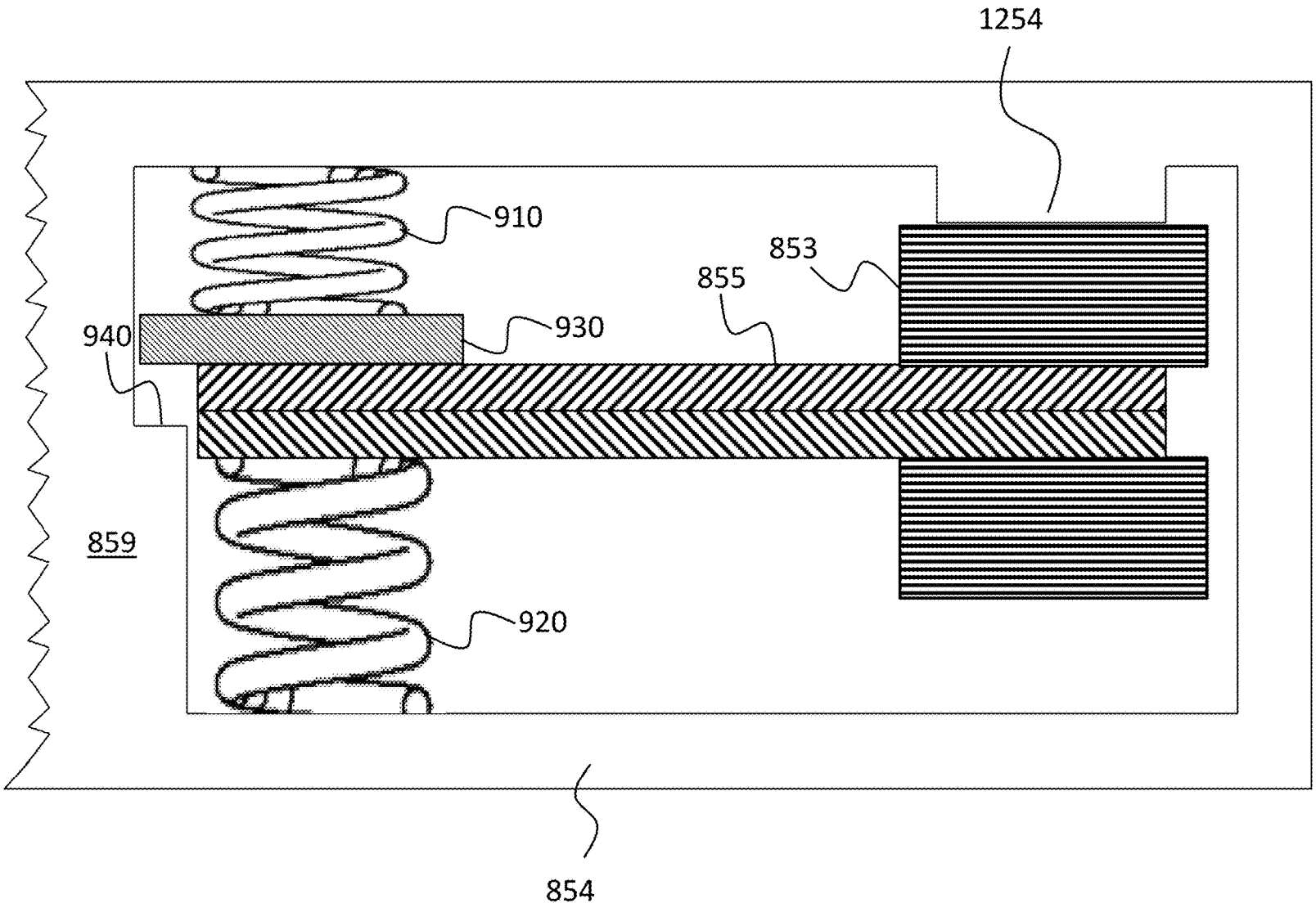
Figure 13:
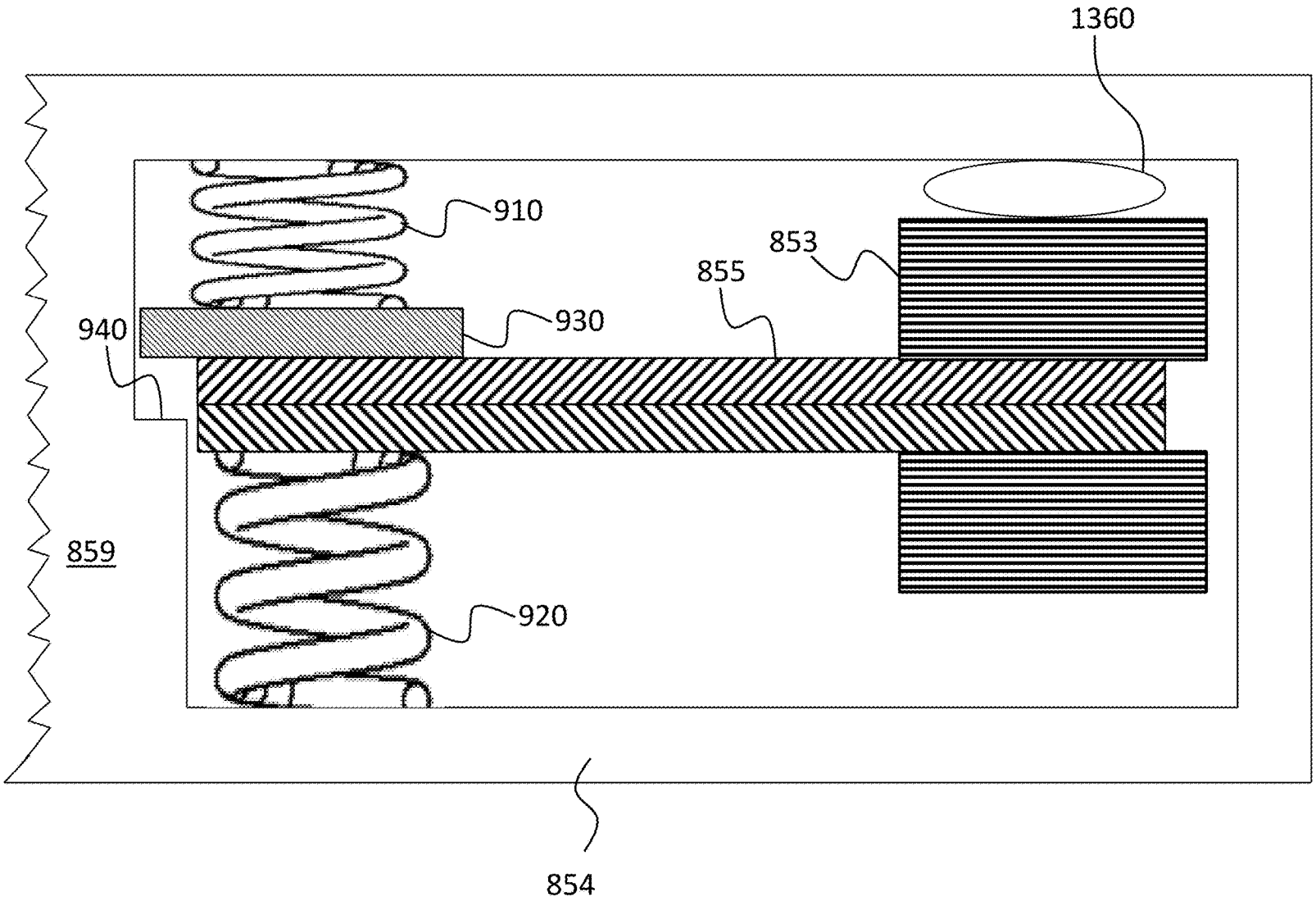

FIG. 13 depicts an alternate exemplary embodiment where the shockproof according to the exemplary embodiment of FIG. 8 is combined with a damping component 1360. In an exemplary embodiment, damping component 1360 is a silicone gel component that extends from the inside of the housing to the upper surface of the counterweight 853 (the schematic of FIG. 13 is the implantable subcomponent in the third mechanical state, and thus the damping component 1360 is depicted in its compressed state). In some exemplary embodiments, such a damping component is located in between the bottom of the counterweight 853 and the housing 854 as well. In an exemplary embodiment, the damping component(s) can be configured such that they are adhered to both the housing and the counterweight. In an alternate embodiment, the damping component can be adhered to only one of the housing and the counterweight, where contact between the other and the damping component occurs upon sufficient movement of the counterweight relative to the housing. Any arrangement that can enable damping according to the teachings detailed herein can be utilized in at least some exemplary embodiments. In the embodiment of FIG. 13, the damping component is also configured to limit the upward travel of the counterweight 853 in a manner analogous to the stop of FIG. 12. In this regard, in an exemplary embodiment, the damping component 1360 can be configured so as to compress no more than a certain amount when exposed to sufficiently high deceleration, beyond which sufficiently high deceleration, other failure modes would occur (e.g., other than the failure mode where the piezoelectric material breaks). Alternatively, the damping component 1360 can be combined with the stops of FIG. 12.

In an exemplary embodiment, the damping component 1360 can correspond to one or more of the embodiments detailed in U.S. patent application Ser. No. 14/555,899, entitled MEDICAL DEVICE HAVING AN IMPULSE FORCE-RESISTANT COMPONENT, filed Nov. 28, 2014, listing Wim Bervoets as an inventor. In an exemplary embodiment, the effective "damping" can be reduced relative to that which is the case in the absence of the teachings detailed herein vis-à-vis enabling the piezoelectric component 855 to move relative to the housing.

Briefly, it is noted that while the embodiment of FIG. 12 depicts a stop only at the top of the housing, it is to be understood that in some exemplary embodiments, a stop can be located on the bottom of the housing alternatively and/or in addition to this. It is also noted that in at least some exemplary embodiments, the top of the housing can be lower such that the utilitarian value of the stop is negated (e.g., the transducer-seismic mass cannot travel upwards a sufficient distance such that the bottom of the piezoelectric component 855 rise above the shoulder 940). It is also noted that in at least some exemplary embodiments, a bushing or the like can be utilized which extends downward a sufficient amount such that the bottom surface of the bushing will not rise above the shoulder 940 with respect to movement of the transducer-seismic mass a distance that results in the counterweight 853 striking the top of the housing. Any arrangement that can prevent the failure mode where the piezoelectric component 855 becomes hung up on the shoulder 940 can be utilized in at least some exemplary embodiments.

To be clear, while the stop and the dampener component have been depicted as present on the top of the implantable subcomponent, in an alternate embodiment, the stop and/or the damper can be located on the bottom (and such component can be located at both places).

Figure 14A:
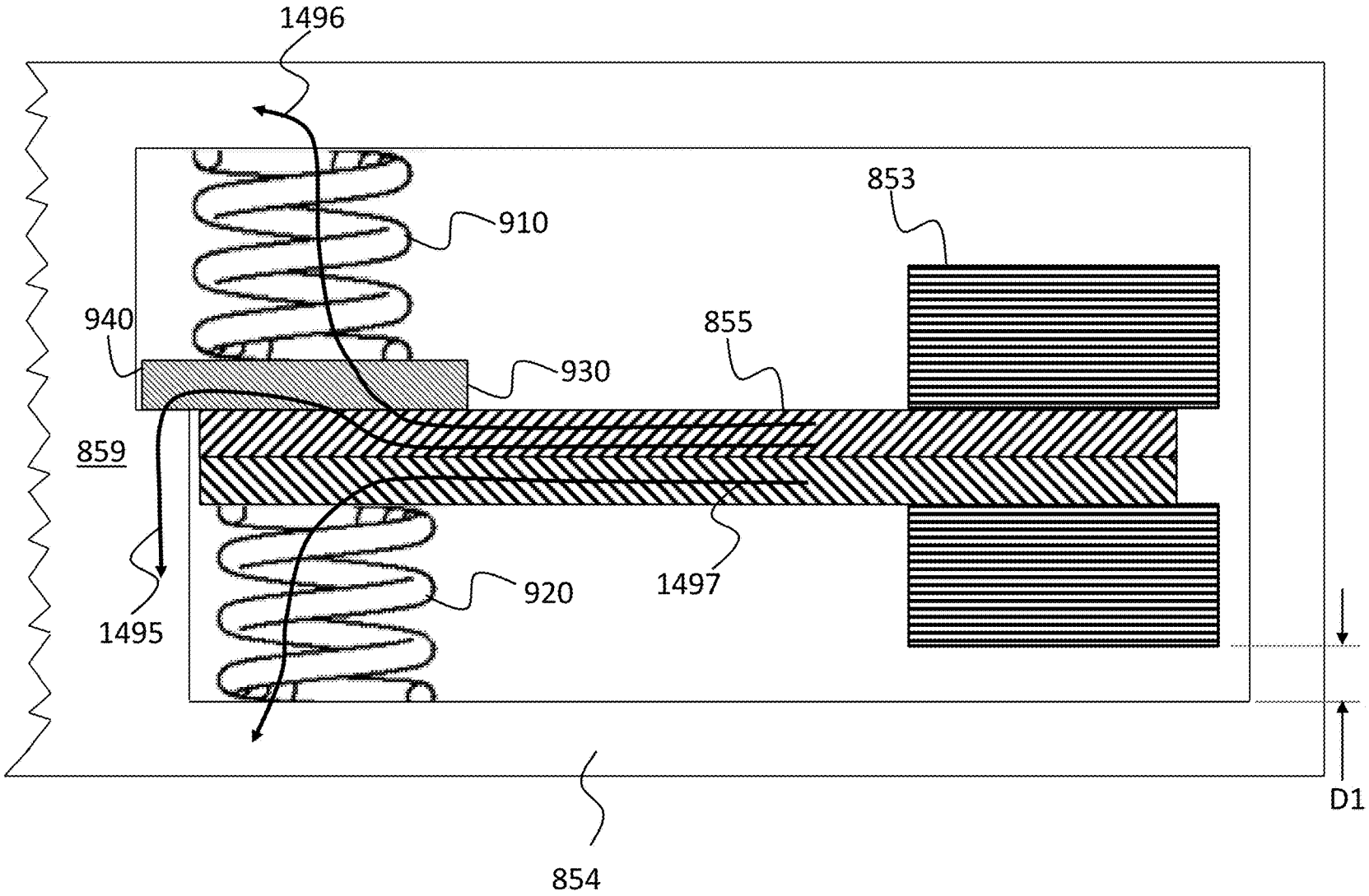
Figure 14B:
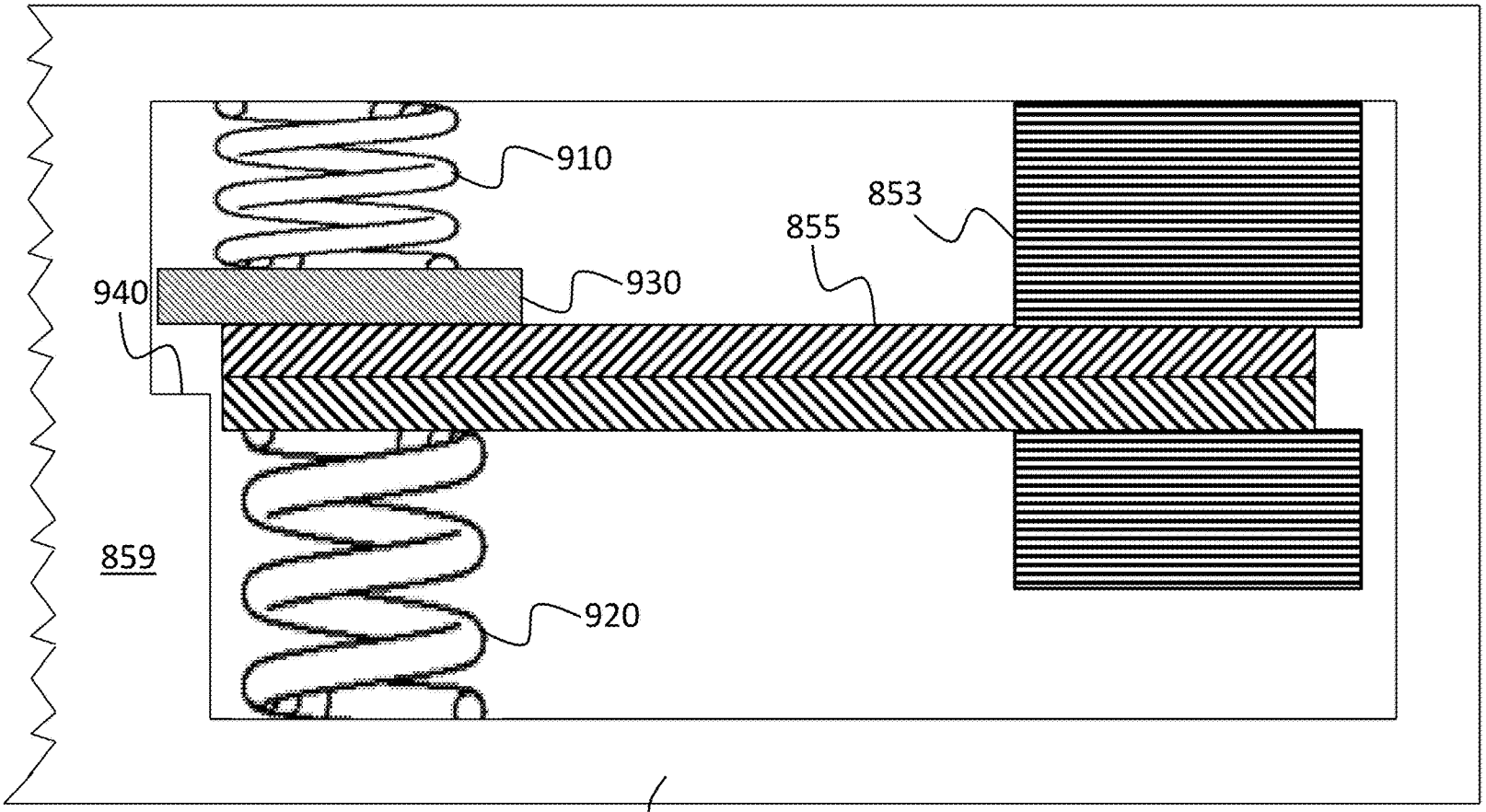

FIG. 14B depicts another alternate embodiment where the counterweight 853 has a height dimension above the piezoelectric component 855 that is greater than that which is the case below the piezoelectric component 855. Here, the extra height of the counterweight 853 prevents the upward movement of the piezoelectric material 855 beyond that where the bottom surface of the piezoelectric material 855 would rise above the shoulder 940.

Some exemplary embodiments of the shoulder 940 when used in combination with the washer 930 will now be described. It is briefly noted that in some exemplary embodiments, as will be described below, there is no shoulder and/or washer.

With reference to FIG. 9, in embodiments where the shoulder 940 is present, shoulder 940 prevents further extension of spring 910 in the downward direction. (It is briefly noted that in the exemplary embodiments detailed herein, there are two springs 910 located on either side of the core 859. In some embodiments, three or four or five or six or more springs 910 are arrayed about core 859—for purposes of linguistic economy, reference will be made to only one spring on one side—all references to one spring on one side correspond to references to the other springs on the other side unless otherwise specified.) That is, the downward force on washer 930 by spring 910 owing to its compression relative to the relaxed state of spring 910 is constant and limited to that which results from the distance between the top of the washer 930 and the inside surface of the top of the housing 840. In an exemplary embodiment, in the first mechanical state, this is F1. F1 equals the force which results from the distance that the spring 910 is compressed from its relaxed state times the k value of the spring (in this exemplary embodiment, spring 910 is a traditional spring where the k value is constant, and the force required to compress the spring increases linearly with increasing compression). Because washer 930 becomes hung up on shoulder 940, accurate tolerancing and/or positioning of the springs need not be necessary. In at least some exemplary embodiments, all that is necessary is that the bottom spring 920 not exert an upward force on the piezoelectric component 855 that exceeds F1 to maintain the piezoelectric material in the first mechanical state. In this regard, in an exemplary embodiment, in the first mechanical state, the upward force on the piezoelectric component 855 by spring 920 owing to its compression relative to the relaxed state of spring 920 is constant and limited to that which results from the distance between the bottom surface of the piezoelectric component 855 and the inside surface of the bottom of the housing 840. In an exemplary embodiment, in the first mechanical state, this is F2, where F2 equals the force which results from the distance that the spring 920 is compressed from its relaxed state times the k value of the spring (as with the spring 910, the spring 920 is a linear spring—as will be described below, springs having nonlinear characteristics can be utilized—in some embodiments, both springs have such characteristics, while in other embodiments, only one of the two springs—the upper or the lower —has these characteristics). Providing that F2 is less than F1, washer 930 will always be resting on shoulder 940, and piezoelectric component 855 will always be located at a specified/constant height above the bottom interior surface of the housing and below the top interior surface of the housing in a 1 G environment.

In an exemplary scenario where there exists downward deceleration or upward acceleration, the force acting against the compression of spring 920 will correspond to the combined mass of the piezoelectric component and the counterweight (the transducer-seismic mass assembly) times the acceleration/deceleration (i.e., $F=m\times a$). The washer 930 has no impact on this because the weight thereof is supported by shoulder 940. That said, in an alternate embodiment, such as where washer 930 is replaced with a component that can articulate relative to the core and the piezoelectric material 855, as will be described in greater detail below, the mass would include at least a portion of this component. In any event, for the purposes of this discussion, the washer 930 does not contribute to the mass of the transducer-seismic mass assembly. In, for example, acceleration and/or deceleration corresponding to 2 or 3 Gs, in an exemplary embodiment, the downward force F3 will increase 2 or 3 times from that which exists in the first mechanical state in a 1 G environment. If the downward force F3 is less than the upward force F2 resulting from spring 920 being compressed from its relaxed state, the piezoelectric component 855 will not move from the first mechanical state. However, if the downward force F3 is greater than the upward force F2, the piezoelectric component 855 will move from the first mechanical state, and thus the piezoelectric component 855 will move downward. If F3 and F2 should be in equilibrium with increasing values of F3 until the counterweight 853 strikes the housing, thus preventing further downward movement of the transducer-seismic mass assembly. Thereafter, F3 will not increase in any effective manner, because the piezoelectric component 855 will be prevented from further downward movement and/or any further downward movement will be based effectively solely on the weight of the piezoelectric component 855, as the counterweight will be resting on the housing, and because the mass of the piezoelectric component 855 is relatively minimal, any additional increase in force F3 can be absorbed by the piezoelectric material without causing a failure mode.

Upon the decrease in the acceleration component that resulted in the development of force F3, F3 will be reduced back to its normal value that results in the presence of a 1 G environment, and thus the force F2 generated by spring 920 will then dominate, pushing the piezoelectric material 855 upwards towards washer 930. When piezoelectric material 855 strikes washer 930, further upward movement of the piezoelectric material 855 will be halted (albeit some additional movement may be present owing to momentum effects, which will be absorbed by spring 910). Ultimately, the piezoelectric component will return back to that which existed in the first mechanical state. Because the piezoelectric material was not deformed in any substantial manner, owing to the fact that the piezoelectric material was permitted to move in its entirety with the counterweight, a bending force on the piezoelectric material which otherwise might have existed did not develop, even though the acceleration/deceleration regime was sufficient to cause the counterweight to strike the inside of the housing (which, in a scenario where the inboard portions of the piezoelectric component were hard mounted to the core, would have corresponded to the maximum amount that the piezoelectric material could be bent—FIG. 7).

With respect to spring 920 the reverse is the case. Upon a sufficiently high enough deceleration with the implantable component moving in the upward direction, the force F4 imparted on to washer 930, and thus spring 910 will become greater than the force F1 (and prior to that, it will be less than force F1, and thus the piezoelectric component 855 will not move), which will in turn cause spring 910 to compress. This will permit washer 930 to move upwards, and thus permit piezoelectric component 855 to move upwards. The upward movement will be concomitant with the downward movement described above, albeit in reverse, and will not be described further for purposes of textual economy.

In an exemplary embodiment, F1 is greater than F2, so as to maintain the position of the piezoelectric material 855. F1 is also equal to F4, where F4 is a combination of F2 from spring 920 (which reduces with upward movement of the piezoelectric component 855 because the spring 920 is extending, and thus reducing the upward force imparted on to the piezoelectric material 855 from that which existed in its compressed state in the first mechanical state) plus the force resulting from the mass of the piezoelectric component and the counterweight (the transducer-seismic mass assembly) plus the washer 930 (which was not a player in the force balance equations with respect to downward movement because the washer 930 was supported by the shoulder 940) times the acceleration component (hereinafter, F5, and thus $F4=F2+F5$).

By sizing the first and second springs appropriately, any deleterious effect resulting from the forces of the springs imparted onto the piezoelectric component 855 during any part of the travel thereof from the first mechanical state to the second mechanical state and/or the third mechanical state can be mitigated. Moreover, in an exemplary embodiment, a stop can be included in, for example, spring 920, that prevents the spring from extending beyond an extension point, wherein further movement of the piezoelectric component 855 upward is not subject to the force F2 imparted by spring 920. That said, embodiments according to the teachings detailed herein can be practiced without such stops.

In view of the above, it can be understood that in an exemplary embodiment, there is a prosthetic metal device, such as by way of example only and not by way of limitation, a bone conduction device in general, and an implantable component of an active transcutaneous bone conduction device in particular (as will be detailed below, the teachings herein are also applicable to an external component of a passive transcutaneous bone conduction device and/or the removable component of a percutaneous bone conduction device). In view of the above, it can be understood that in an exemplary embodiment, the medical device includes a housing, and a piezoelectric component located therein. In an exemplary embodiment, the piezoelectric component is supported within the housing via at least one spring. As can be seen from FIG. 8, in an exemplary embodiment, the spring is a coiled spring. However, as will be described in greater detail below, in an exemplary embodiment, the spring can be a leaf spring. Still further, in an exemplary embodiment, the spring can be a Belleville spring. Any spring that can enable the teachings detailed herein and/or variations thereof can be utilized in at least some exemplary embodiments. In accordance with the teachings of FIG. 8, in an exemplary embodiment, the piezoelectric component is directly supported in the housing by the at least one spring. Still further, also in accordance with the teachings of FIG. 8, in an exemplary embodiment, the piezoelectric component can also be indirectly supported in the housing by the at least one spring (e.g., via the washer 930).

In accordance with the teachings detailed above, in an exemplary embodiment, this medical device is configured to permit the piezoelectric component to move inside the housing beyond that which is due to electricity applied to the piezoelectric component. In this regard, in an exemplary embodiment, the application of electricity to the piezoelectric component, at a maximum current and/or a maximum voltage that can be applied by the medical device, will cause the piezoelectric component to bend upward or downward, and the application of an alternating current will cause the piezoelectric component to bend upward or downward and vice versa. That said, in some embodiments, the piezoelectric component is such that in a de-energized/non-energized state, the piezoelectric component is bent downward (or upward), and the application of electrical current there to cause the piezoelectric component to bend upward (or downward), and the removal of the current there from causes the piezoelectric component to return to its de-energized/non-energized state, thus causing vibrations. In any event, the maximum bending that can result from application of the maximum current applyable by the medical device will cause the piezoelectric component to move (bend). In an exemplary embodiment, the medical device is configured to permit the piezoelectric component to move inside the housing beyond that which is due to electricity applied to the piezoelectric component, and, in some embodiments, beyond that which results from the maximum amount of electricity with respect current and/or voltage that is applicable to the piezoelectric component by the medical device.

For example, FIG. 14B depicts a schematic of the implantable subcomponent in the first mechanical state. Energizement of piezoelectric component 855 (or de-energizement in the embodiment where the piezoelectric component 855 is bent downward in its de-energized state) with a first current polarity (of a system with a current regime that changes to have an opposite polarity) causes the distance D1, the distance of the outboard bottom tip of the counterweight 853 (the portion of the transducer-seismic mass assembly that comes closest to the bottom of the housing during normal actuation thereof/when the piezoelectric component 855 is energized or de-energized) when the piezoelectric component is not energized in a 1 G environment with the direction of gravity acting downward, to decrease (or increase) by about X, and energizement of the piezoelectric component 855 with a second current polarity opposite the first current polarity (or energizement in the embodiment where the piezoelectric component 855 is bent downward in its de-energized state) causes the distance D1 to increase (or decrease) by about X. In an exemplary embodiment, X is about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.5, 3.0, 3.5, 4.0, 4.5, 5.0, 5.5, 6.0, 6.5, or 7.0 microns, or any value or range of values therebetween in 0.01 micron increments. X can be greater than that.

In any event, the shock-proofing according to the teachings detailed herein can enable the piezoelectric component to move such that the value of D1 is reduced by at least 10%, 25%, 50%, 75%, or 100%, or any value or range of values therebetween in 0.1% increments, when subjected to a given acceleration and/or deceleration, as noted above. In an exemplary embodiment, the shock-proofing detailed herein can enable the piezoelectric component to move such that the value of D1 is reduced by an amount that is at least Y times the amount that D1 is reduced (or increased) as a result of energizement of the piezoelectric component (e.g., at the maximum current and/or voltage appliable to the piezoelectric component by the medical device), where Y is 5, 6, 7, 8, 9, 10, 11, 12, 13, 14, 15, 20, 25, 30, 35, 40, 45, 50, 55, 60, 65, 70, 80, 90, 100, 110, 120, 130, 140, 150, 175, 200, 225, 250, 375, 400, 450, 500, 550, 600, 650, 700, 750, 800, 850, 900, 950, 1000, 1100, 1200, 1300, 1400, 1500, 1600, 1700, 1800, 1900, 2000, 2250, 2500, 2750, 3000, 3500, 4000, 4500, 5000, 5500, 6000, 7000, 8000, 9000, 10000, 12500, or 15000 or more, or any value or range of values therebetween in 1 times increments, was subject to a given acceleration and/or deceleration, as noted above. Of course, as detailed above, in an exemplary embodiment, the medical device is configured to permit a seismic mass, such as the counterweight, supported by the piezoelectric component to strike a housing wall of the housing, thus halting further downward movement and/or upward movement. It is noted that the aforementioned values associated with D1 can be applicable to the outboard upper tip of the counterweight 853 as well.

Consistent with the embodiments detailed above where there is a gap between the inboard portions of the piezoelectric component 855 and the core 859 of the housing, in an exemplary embodiment, the medical device is a core component about which the piezoelectric component extends, and the piezoelectric component is configured to move along a longitudinal axis of the core as a result of compression of the at least one spring. Corollary to this is that in an exemplary embodiment, the piezoelectric component is configured to move along a longitudinal axis of the core in opposite direction as a result of compression of a spring that is when an opposite side of the piezoelectric component 855 from the at least one spring.

Still with respect to the embodiment of FIG. 8, as noted above, the subcomponent depicted in FIG. 8 is the implantable component of a bone conduction device. That said, in an alternate embodiment, the component of a bone conduction device in which the teachings detailed herein can be applicable can correspond to the external component of a passive transcutaneous bone conduction device, with a vibrator/transducer is located external to the recipient. As with the implantable component, the external component can also include a housing, and the transducer-seismic mass assembly, although in an exemplary embodiment, the housing may not necessarily be hermetically sealed, whereas in the implantable component depicted in FIG. 8, the housing is hermetically sealed from the external environment (although in other embodiments, this may not necessarily be the case, either). Note also that the teachings detailed herein with respect to shock-proofing the transducer-seismic mass assembly can also be applicable to the vibrator of a percutaneous bone conduction device, which also will include a housing, although, as with the housing of the passive transcutaneous bone conduction device containing the transducer-seismic mass assembly, that housing may not necessarily be hermetically sealed as well. In any event, irrespective of the species of bone conduction device to which the teachings detailed herein are applicable, in an exemplary embodiment, the component of the bone conduction device containing the transducer-seismic mass assembly is configured to permanently shock-proof the assembly beyond that which results from damping.

In an exemplary embodiment, the permanently shock-proofing is a result of the component being configured to automatically at least partially decouple a vibratory path extending from the transducer-seismic mass assembly to the housing upon the hosing experiencing a G force above a certain level. In an exemplary embodiment, the G force level that results in the decoupling is 3, 4, 5, 6, 7, 8, 9, 10, 11, 12, 13, 14, 15, 16, 17, 18, 19, 20, 21, 22, 23, 24, 25, 26, 27, 28, 29, 30, 35, 40, 45, 50, 55, 60, 65, 70, 75, 80, 85, 90, 100, 125, 150, 175, 200, 250, 300, 350, 400 Gs or more, or any value or range of values therebetween in 0.1 G increments.

FIG. 14A depicts an exemplary vibratory path 1495 extending from the piezoelectric material 855 to the washer/bridge 930 to the core 859 of the housing 854, from which the vibrations then transfer into the bone of the recipient and/or into the bone fixture of the recipient, or any other intermediate component, and then into the bone of the recipient to evoke a hearing percept via bone conduction. It is also noted that in an alternate embodiment, where the divisive FIG. 14A is being utilized as a sensor transducer, the vibratory path 1495 would be in the opposite direction from that represented by the arrow tip. It is noted that in some embodiments, the entire vibratory path from the piezoelectric material to the bone travels through the bridge 930 to the core 859, bypassing the springs 910 and/or 920. That said, in some alternate embodiments, at least a portion of the vibratory path from the piezoelectric material 855 extends through one or both of the springs 910 and 920 to the housing, as represented by the arrows of 1496 and 1497 in FIG. 14A. In some embodiments, the entire vibratory path extends through the springs, bypassing the connection between the bridge 930 and the core 859. In any event, in the second mechanical state, as represented by FIG. 14B, where the bridge 930 is lifted off of the shoulder of the core 859, the vibrational path 1495 is decoupled because the bridge 930 is no longer in contact with any part of the housing (no longer in direct contact with any part of the housing). In the case where the vibrational path is entirely made up of the path that extends from the bridge 930 to the housing, the vibratory path extending from the transducer-seismic mass assembly to the housing is completely decoupled. In the case where the vibrational path is only partially made up of the path that extends from the bridge 930 to the housing, the vibrational path extending from the transducer-sized mass assembly to the housing is partially decoupled.

The decoupling is automatic as it occurs without user input upon the component experiencing the G force above a certain level. This is contrasted to a situation where the recipient or some other person affirmatively takes an action to decouple the vibrational path. As will be described in greater detail below, in some embodiments, the implantable components or any other components for that matter including a device that locks the vibrational path in place, so that the vibrational path will not be decoupled when the component is exposed to a given G force level. The ability to lock the vibrational path in place from an unlocked state does not mean that the component is not configured to permanently shockproof the assembly beyond that which results from damping. That is, in an exemplary embodiment that includes this locking feature, if the locking feature is engaged such that the vibrational path will not be decoupled when the component experiences the G force levels, if the vibrational path would be decoupled in the absence of the locking, such a component meets the feature of having the permanent shock proofing detailed herein, even though at that time the component is not shock proofed. It is also the case that such a component meets the other feature detailed herein regarding the ability of a component to enable the transducer-seismic mass assembly to translate within the housing, etc. That is, even in the presence of such a lock, because the device, prior to the locking, meets these features, such a device meets these features after the locking.

As noted above, after the acceleration and/or deceleration is relieved from the component, the transducer-seismic mass assembly returns to that which is present in FIG. 14A (the first state). Thus, in an exemplary embodiment, the implantable component is configured to automatically reestablish the vibratory path extending from the transducer-seismic mass assembly to the housing upon the housing being relieved from exposure of the G force above the certain level. It is noted that in an alternate embodiment, this return can be a result of a relief from exposure to G forces different than the forces which resulted in the decoupling and the first instance. That is, in an exemplary embodiment, the threshold level that resulted in the decoupling can be different than the threshold level that results in the recoupling. It is also noted that in an exemplary embodiment, the decoupling associated with downward movement of the transducer-seismic mass assembly can have a different threshold value than that which results in decoupling with respect to upward movement of the transducer-seismic mass assembly, owing to, for example, the difference in the spring pretensions, etc.

In view of the above, in an exemplary embodiment, there is a device, such as a medical device, such as a bone conduction device, where the piezoelectric component is configured to vibrate in response to a captured sound, and the medical device is configured such that at least some of the vibrations generated by the piezoelectric component travel from the piezoelectric component to the core via a vibration bridge (e.g., bridge 930).

Consistent with the teachings detailed above, in at least some exemplary embodiments, the transducer-seismic mass assembly includes a counterweight (e.g., 853), and the permanent shock-proofing is a result of the implantable component being configured to enable the counterweight to strike an interior of the housing upon subjecting the housing to a G force that would otherwise break the transducer-seismic mass assembly in the absence of the shock-proofing. In this regard, in an exemplary embodiment, the G force can be 3, 4, 5, 6, 7, 8, 9, 10, 11, 12, 13, 14, 15, 16, 17, 18, 19, 20, 21, 22, 23, 24, 25, 26, 27, 28, 29, 30, 35, 40, 45, 50, 55, 60, 65, 70, 75, 80, 85, 90, 100, 125, 150, 175, 200, 250, 300, 350, 400 Gs, or more, or any value or range of values therebetween in 0.1 G increments.

Also consistent with the teachings detailed above, the transducer-seismic mass assembly can include a piezoelectric bender (855 is a bender) and one or more counterweights 853 located at ends of the piezoelectric bender. (It is noted that the teachings herein can be applicable to expansion and contraction piezoelectric components in addition to benders.) In some embodiments, the implantable component is configured to apply an electrical current to the piezoelectric bender to cause the piezoelectric bender to bend in a vibratory manner, thereby moving the one or more counterweights towards and away from a surface of the housing in a vibratory manner. In some exemplary embodiments, such results in the evocation of a bone conduction hearing percept per the teachings detailed herein. In some embodiments, the piezoelectric bender is non-rigidly connected to the housing (e.g., such as the embodiment of FIG. 8), and the implantable component is configured such that vibrations from the piezoelectric bender travel therefrom to the housing to evoke a hearing percept (again, such as the embodiment of FIG. 8). This is contrasted to an embodiment where the piezoelectric material clamped to the housing or the like.

Also, in some embodiments, again, the transducer-seismic mass assembly includes a piezoelectric bender and one or more counterweights located at ends of the piezoelectric bender, and the implantable component is configured to apply an electrical current to the piezoelectric bender to cause the piezoelectric bender to bend in a vibratory manner, thereby moving the one or more counterweights towards and away from a surface of the housing in a vibratory manner. In this embodiment, the piezoelectric bender is springingly clamped within the housing (e.g., as is the case with respect to the embodiment of FIG. 8).

Also, with respect to the embodiments of the transducer-seismic mass assembly that includes a piezoelectric bender, as seen above, in some embodiments, the bender surrounds a core of a housing. Again, in an exemplary embodiment, when viewed from the top (or bottom), the piezoelectric bender looks like a non-square rectangle (e.g., "Hershey bar"), with a hole through the center through which the core 859 extends. In view of the above embodiments, as can be seen, portions of the piezoelectric bender that are directly adjacent the core (e.g., the interior diameter of the hole through the bender, which hole can have a circular cross-section to accommodate a circular cross-section core, a square cross-section to accommodate a square cross section core, etc.) can move in a direction parallel to a longitudinal axis of the core (i.e., with respect to the frame of reference of FIG. 8, up and down) when the piezoelectric bender is subjected to a force greater than XXX Newtons in a direction parallel to the longitudinal direction, thereby permanently shock-proofing the assembly. In an exemplary embodiment, XXX is 3, 4, 5, 6, 7, 8, 9, 10, 11, 12, 13, 14, 15, 16, 17, 18, 19, 20, 21, 22, 23, 24, 25, 26, 27, 28, 29, 30, or more Newtons, or any value or range of values therebetween in 0.01 Newtons. As with all of the movements detailed herein and variations thereof, such movement can be automatic upon experiencing such forces. Still further, in an exemplary embodiment, the implantable component or any other components that matter configured such that portions of the piezoelectric bender that are directly adjacent the core will not move in the aforementioned parallel direction to the longitudinal axis when the bender is subjected to a force that is not greater than YYY, where YYY is 1, 2, 3, 4, 5, 6, 7, 8, 9, 10, 11, 12, 13, 14, 15, 16, 17, 18, 19, 20, 21, 22, 23, 24, 25, 26, 27, 28, 29, 30 Newtons, or any value or range of values therebetween in 0.01 N. By way of example only and not by way of limitation, in an exemplary embodiment, the implantable component can be configured such that a force of 8.75 Newtons in one direction will cause the bender to move relative to the core, while a force of 8.74 N in that same direction will not cause the bender to move relative to the core.

Consistent with the teachings detailed above, in an exemplary embodiment, there is a component of a transcutaneous bone conduction device (passive or active transcutaneous bone conduction device), comprising a housing, such as any of the housing's detailed herein and/or variations thereof, and a transducer-seismic mass assembly. In at least some of these exemplary embodiments, the transducer-seismic mass assembly of the transcutaneous bone conduction device is configured to translate in its entirety within the housing. By "in its entirety," this means that every portion thereof can translate. This as opposed to any such translation which can occur in a scenario where, for example, the piezoelectric bender is clamped rigidly to the core of the housing and the piezoelectric material is energized or otherwise provided with an electrical current to cause the bender to bend, where any translation is limited to the portions of the piezoelectric bender that are not clamped.

In at least some of the exemplary embodiments detailed above, the transducer-seismic mass assembly is supported within the housing via at least two separate springs, both of which are in compression. With respect to at least some embodiments, the springs are in compression such that the springs provide a clamping force on either side of the piezoelectric bender. Thus, the compression forces are opposite one another (in some instances, the compression forces are equal, while in other instances, the compression forces need not be equal (relative to each spring).

The transducer-seismic mass assembly, in some embodiments, is at least indirectly sandwiched between a first spring under a first compression force and a second spring under a second compression force on an opposite side of the transducer-seismic mass assembly from the first spring. In some instances, the transducer-seismic mass assembly is configured to translate in the direction of the first spring upon the transducer-seismic mass assembly applying a force against the first spring greater than the first force, and the transducer-seismic mass assembly is configured to translate in the direction of the second spring upon the transducer-seismic mass applying a force against the second spring greater than the second force. In some embodiments, the transducer-seismic mass assembly is configured to only translate in the direction of the first spring upon the transducer-seismic mass assembly applying a force against the first spring greater than XYZ times the first force, and the transducer-seismic mass assembly is configured to only translate in the direction of the second spring upon the transducer-seismic mass applying a force against the second spring greater than ABC times the second force. In an exemplary embodiment, XYZ and/or ABC is 1.01, 1.05, 1.1, 1.15, 1.2, 1.25, 1.3, 1.35, 1.4, 1.45, 1.5, 1.55, 1.6, 1.65, 1.7, 1.75, 1.8, 1.85, 1.9. 1.95, 2.0, 2.1, 2.2, 2.3, 2.4, 2.5, 2.6, 2.7, 2.8, 2.9, 3.0, 3.25, 3.5, 3.75, 4.0, 4.25, 4.5, 4.75, 5.0, 5.5, 6.0, 7.0, 8.0, or more, or any value or range of values therebetween in 0.01 increments. To be clear, in some embodiments, XYZ is equal to ABC.

In some embodiments, the first compression force is greater than the second compression force when the entirely of the transducer-seismic mass is static relative to the housing. In an exemplary embodiment, the first compression force is 1.01, 1.05, 1.1, 1.15, 1.2, 1.25, 1.3, 1.35, 1.4, 1.45, 1.5, 1.55, 1.6, 1.65, 1.7, 1.75, 1.8, 1.85, 1.9. 1.95, 2.0, 2.1, 2.2, 2.3, 2.4, 2.5, 2.6, 2.7, 2.8, 2.9, 3.0, 3.25, 3.5, 3.75, 4.0, 4.25, 4.5, 4.75, 5.0, 5.5, 6.0, 7.0, 8.0, or more times the second compression force, or any value or range of values therebetween in 0.01 increments.

In some exemplary embodiments, as detailed above, the transducer-seismic mass assembly is in vibrational communication with the housing via a vibration bridge, such as by way of example only and not by way of limitation, washer 930, extending from the transducer-seismic mass assembly to the housing and in contact with both the transducer-seismic mass and the housing. As can be seen from the embodiments associated with FIG. 8, in some of these embodiments, the vibration bridge is not secured to the housing or the transducer-seismic mass. In this regard, in an exemplary embodiment, the vibration bridge can translate relative to the housing and/or relative to the piezoelectric material. In an exemplary embodiment, for an energizement regime of the piezoelectric bender that results in a frequency of 1000 Hz and an output force of 1 Newton, as measured at the bone fixture when the bone fixture is rigidly coupled to the housing 854, such that nothing else contacts the housing 854, of the energy that reaches the bone fixture, at least 20%, 30%, 35%, 40%, 45%, 50%, 55%, 60%, 65%, 70%, 75%, 80%, 85%, 90%, 95%, or 100%, or any value or range of values therebetween in 0.1% increments travels through the vibration bridge (as opposed to through the springs).

In an exemplary embodiment where the transducer-seismic mass assembly is in vibrational communication with the housing via the vibration bridge extending from the transducer-seismic mass assembly to the housing, the component is configured to force the vibration bridge into full contact with the transducer-seismic mass and vis-a-versa when the transducer-seismic mass is actuated to evoke a bone conduction hearing when subject to less than a XXXX G environment. In an exemplary embodiment, XXXX is 3, 4, 5, 6, 7, 8, 9, 10, 11, 12, 13, 14, 15, 16, 17, 18, 19, 20, 21, 22, 23, 24, 25, 26, 27, 28, 29 or 30 or any value or range of values therebetween in 0.1 increments. Still further, in an exemplary embodiment, the component is configured to enable the transducer-seismic mass to move away from a substantial portion (which includes all) of the vibration bridge when the transducer-seismic mass is subject to an acceleration greater than YYYY G in a first direction. In an exemplary embodiment, YYYY is i3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50, or any value or range of values therebetween in 0.1 increments.

It is briefly noted that with respect to the various thresholds that results in movement, any disclosure of movement occurring at or above a certain value also corresponds to a disclosure of a lack of movement below that value. Still further, it is briefly noted that with respect to the various thresholds that result in lack of movement, any disclosure of lack of movement occurring below or at a certain value also corresponds to a disclosure of movement above that value.

In some exemplary embodiments, the component (whether that be part of an active transcutaneous bone conduction device or a passive transcutaneous bone conduction device) that contains or otherwise includes the vibration bridge is configured such that the vibration bridge is held against the transducer-seismic mass assembly when the transducer-seismic mass is subject to an acceleration greater than YYYY G in a second direction opposite the first direction, with YYYY as detailed above.

Figure 15:
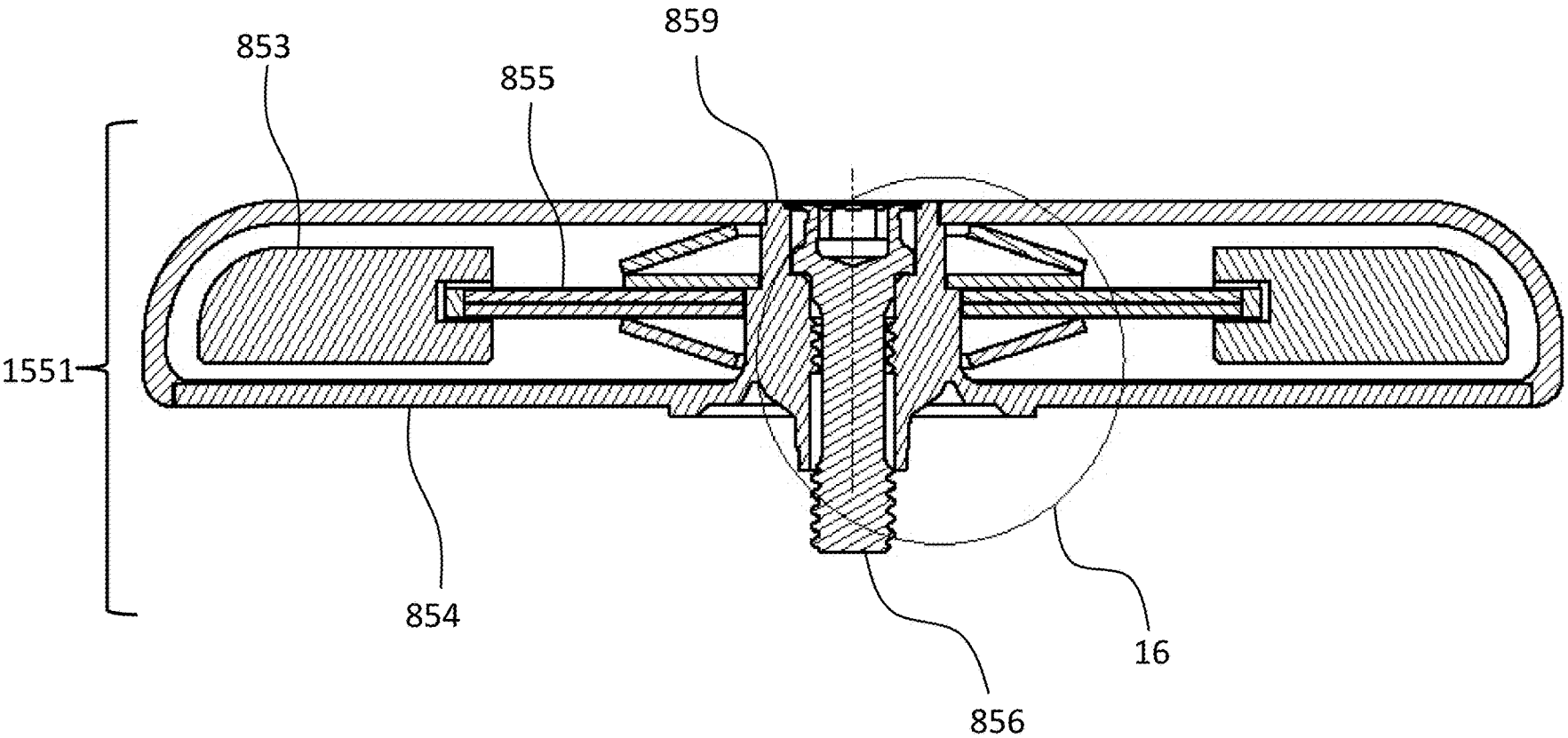
FIGS. 15 and 16 depict an exemplary embodiment of an alternate implementation of the teachings detailed herein.
Figure 16:
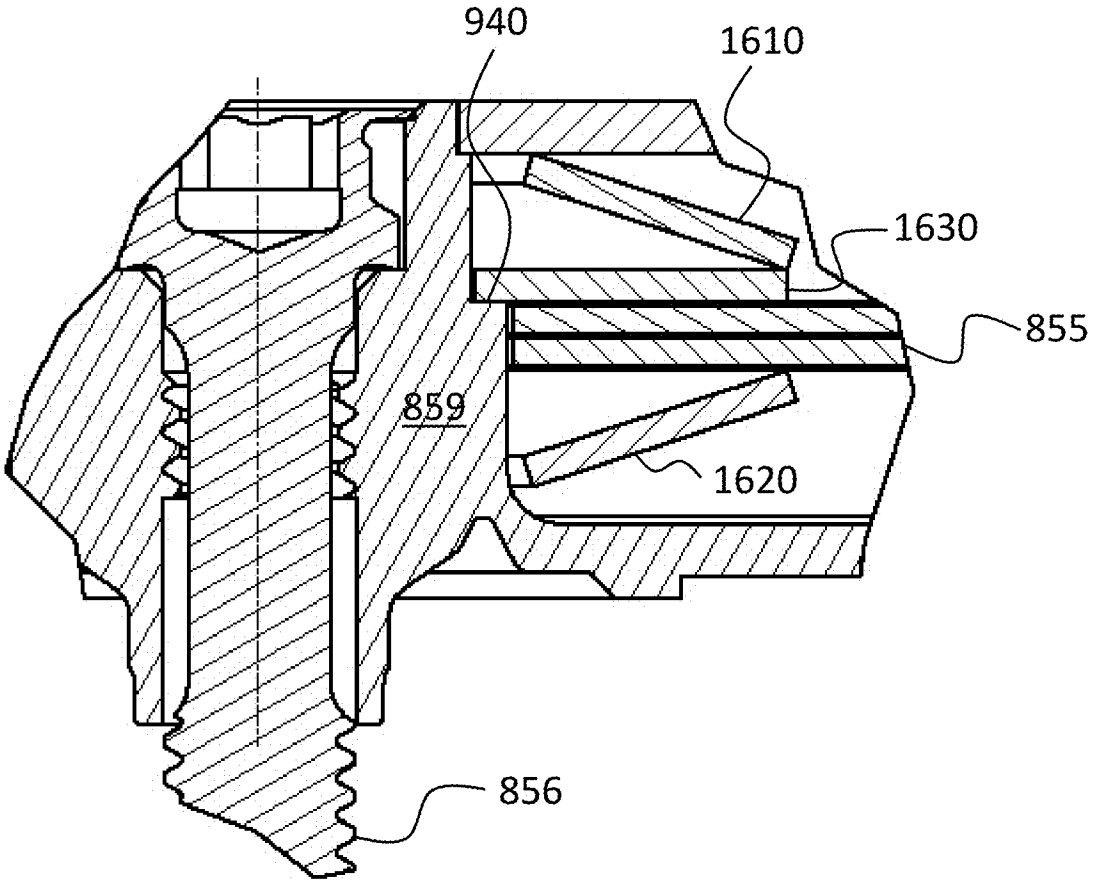

FIGS. 15 and 16 depict a cross-sectional view of another exemplary implantable component 1551 according to an exemplary embodiment. In at least some respects, the principles of operation of the embodiment of FIG. 5 correspond to that of FIG. 8 detailed above. In this embodiment, instead of utilizing helical springs, beveled springs are used. Here, springs 1610 and 1620 are conical springs, or, more accurately, springs in the form of a truncated hollow cone, such that a hole exists in the base and the top. In this regard, with respect to the cross-sectional view of FIG. 15, the springs are rotationally symmetric about the longitudinal axis thereof. FIG. 16 close-up view of the spring system. Also, as can be seen, the embodiments of FIGS. 15 and 16 utilize a bridge 1630 that functionally and/or structurally corresponds to the bridge 930 detailed above.

In some embodiments of FIGS. 15 and 16, the upward movement of the transducer-seismic mass is variously permitted and resisted by the spring 1610 in a manner analogous to and/or the same as the spring 910 detailed above. This is also the case with respect to spring 1620 vis-à-vis spring 920. Again, any spring that will enable the teachings detailed herein and variations thereof to be practiced can be utilized in at least some exemplary embodiments. Furthermore, any type of mechanism, spring or otherwise, that can enable the teachings detailed herein and/or variations thereof, to be practiced can be utilized in at least some exemplary embodiments.

While some embodiments of the embodiments of FIGS. 15 and 16 functionally operate in a manner akin to the coiled springs of FIGS. 8 and 9 detailed above, in some alternate embodiments, the springs of the embodiments of FIGS. 15 and 16 operate in a different manner. In this regard, in an exemplary embodiment, springs 1620 and/or 1610 are so-called Belleville springs. It is briefly noted that in at least some exemplary embodiments, the various types of springs herein can be intermixed. By way of example only and not by way of limitation, in an exemplary embodiment, the bottom spring can be 1620, and the top spring can be spring 910, or vice versa. Still further, in an exemplary embodiment, the top spring system can include a combination of spring 1610 and spring 910 (e.g., such that the spring 910 extends to the top housing wall inboard of the inner diameter of the spring 1610) and/or the bottom spring system can include a combination of spring 1620 and spring 920.

In at least some of the exemplary embodiments of FIGS. 8 and 15, the springs have a spring constant k that is linear with compression. For example, compression of the spring by 5% of its relaxed length will require a first force, and compression of the spring by 10% of its relaxed length will require a second force that is twice the first force, and so on. Conversely, in some exemplary embodiments, compression of the spring by 5% of its length will require a first force, but compression of the spring by 10% of its length require a second force which could be less than 2 times the first force. Thus, in an exemplary embodiment, with respect to the arrangements detailed herein with a first spring located on one side of the transducer-seismic mass assembly, and the second spring located on another side of the transducer-seismic mass assembly, the first spring is configured to compress with increasing resistance to compression within a range of first spring constants when the spring is compressed a first percentage range and the first spring is configured to compress with decreasing resistance to compression within a range of second spring constants when the spring is compressed a second percentage range larger than the first percentage range and adjacent to the first compression range.

The idea is that in an exemplary embodiment, the initial resistance to movement can, in some instances, be higher than the resistance to movement at a later point in the translation of the transducer-seismic mass from the first mechanical state. In an exemplary embodiment, this can have utilitarian value with respect to maintaining the transducer-seismic mass in the first state during normal operation, and permitting relatively easier movement of the transducer-seismic mass to the second state after the transducer-seismic mass "begins moving." That is, once the initial force required to begin movement/translation of the transducer-seismic mass is met, the subsequent force can potentially be less to move the transducer-seismic mass such that it will ultimately contact the housing walls. For example, at least in embodiments that utilize the spring having a circular symmetry about a longitudinal axis, with a center hole, such as the embodiment of FIG. 15, the spring can have non-linear characteristics. Note that in some embodiments, a coil spring can be utilized that extends about the core (e.g., is coaxial with the longitudinal axis of the core or the screw 856, etc.).

Figure 17:
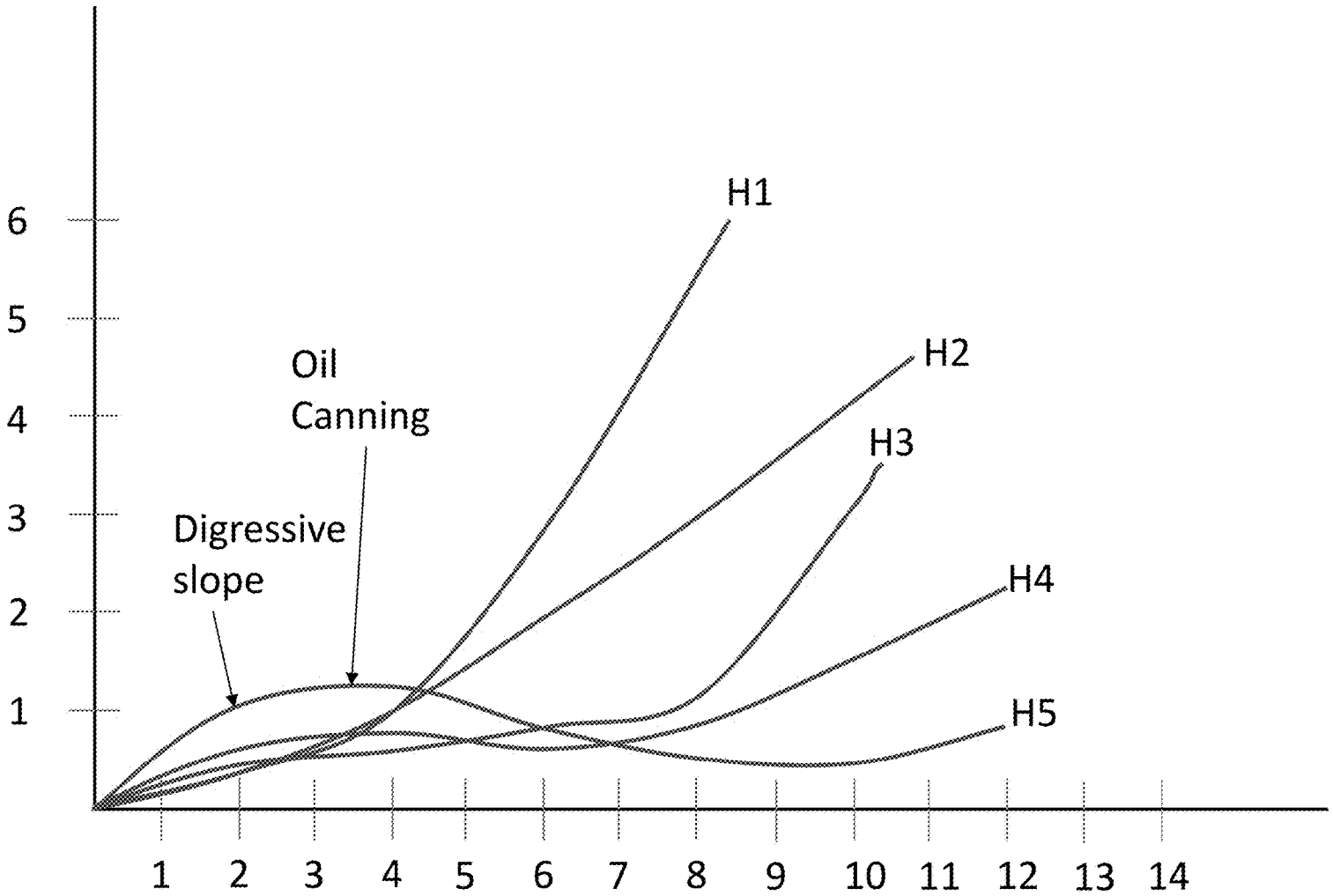
FIG. 17 depicts an exemplary graph containing data associated with the exemplary embodiment of FIGS. 15 and 16.

FIG. 17 depicts an exemplary graph of some exemplary springs that exhibit the nonlinear characteristics. By way of example only and not by way of limitation, these curves are presented for springs according to FIG. 15. In FIG. 17, the vertical axis represents the loading on the spring in a unitized value, and the horizontal axis represents the deflection of the spring, also one a unitized value. The curves are for springs having the same bottom diameter and top diameter and thickness (wall thickness), but for springs having a different height H (the distance in the longitudinal direction). Here, H1 is the lowest height value, and H5 is the highest height value. In an exemplary embodiment, a spring, such as spring H4, can be utilized. As can be seen, the spring has a relatively high initial stiffness, which can have utilitarian value with respect to avoiding deleterious effect associated with the normal vibrating mode/operation of the component in the first mechanical state, such as operation for purposes of invoking a bone conduction hearing percept, in a 1 G or a 1.1, 1.2, 1.3, 1.4 G environment, or thereabouts. As can be seen, the spring is such that it has a spring constant that gradually reduces with increased deflection. In an exemplary embodiment, this can have utilitarian value with respect to avoiding relatively high stresses imparted onto the piezoelectric material. However, such can have utilitarian value with respect to the ability to still absorb a lot of energy. By rough analogy, the dashboard of a modern automobile is designed in a somewhat similar manner. Accordingly, in an exemplary embodiment, the structure that is utilized to support the transducer-seismic mass assembly can be analogous to an energy absorbing structure on a car that has the initial stiffness, but reduces stiffness with further compression.

This exemplary embodiment of utilizing a spring having nonlinear k values can differ with regard to the embodiments detailed above that utilize springs having constant k values. Still, this embodiment has some relationship to the embodiments detailed above in that those embodiments also have a varying effective k value. That is, as is to be understood and as detailed above, in an exemplary embodiment, the transducer-seismic mass will not begin to move until the force applied to the spring overcomes the compression force. Accordingly, the curve will appear initially to be infinite (in that there can be no movement whatsoever by the transducer-seismic mass for a first range of forces), and then after the force corresponding to the value required to compress the spring in the first mechanical state is surpassed, the force/resistance to further compression follows a conventional spring constant. Conversely, the embodiments utilizing the nonlinear spring could also have this first initial feature (no movement until the force equals/passes the force required to compress the spring at the first mechanical state), but, after the force equals/passes the force required to compress the spring of the first mechanical state, and upward movement commences, the force required to continue upward movement could be reduced owing to the nonlinearity of the spring constant.

Figure 18:
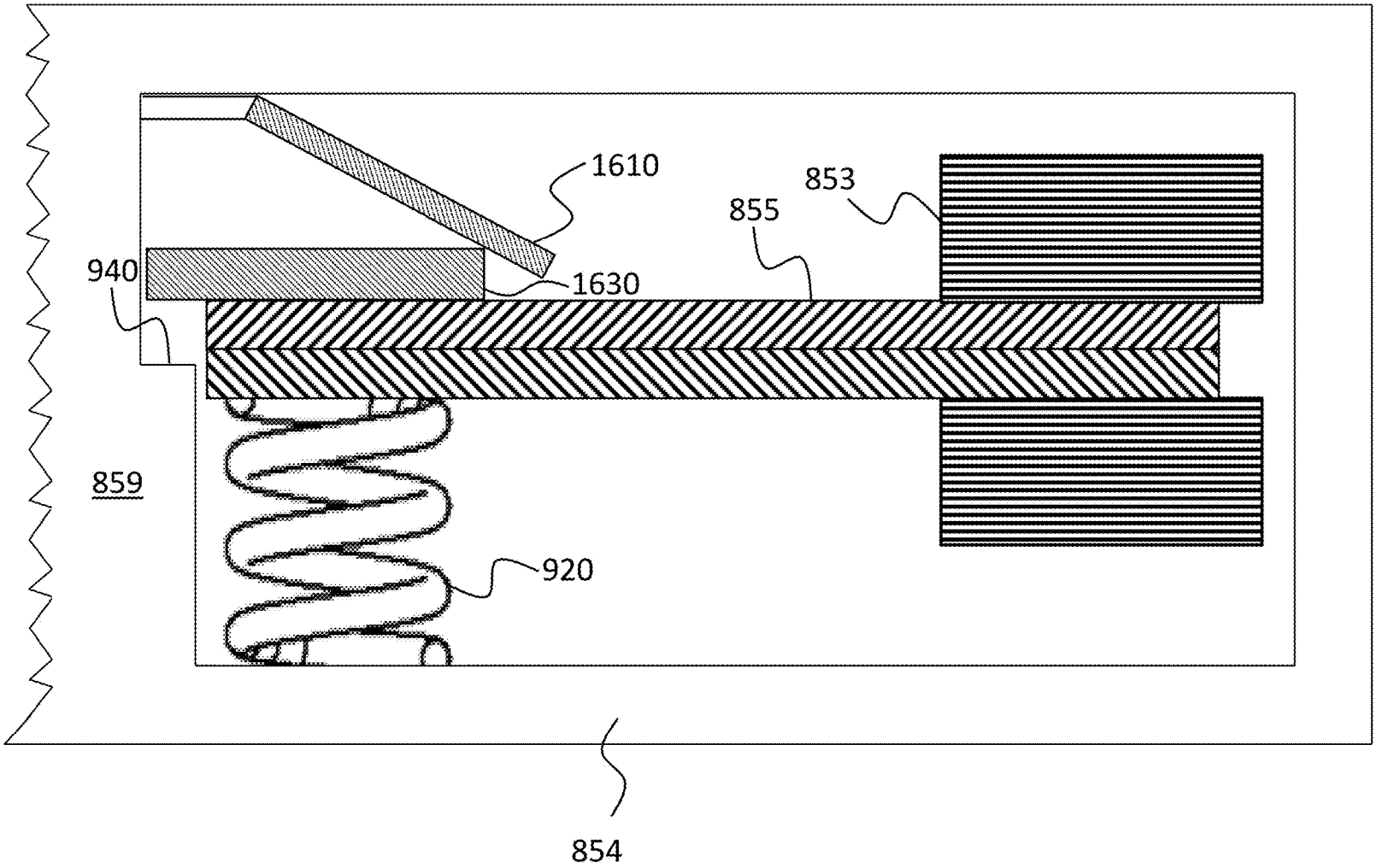
FIGS. 18 and 19 are schematic diagrams depicting various alternative embodiments of the teachings detailed herein.

In the embodiment of FIG. 1516, the bridge 1630 is slightly longer than the bridge 930 detailed above. It is also noted that in at least some exemplary embodiments, the bridge is longer than that depicted in FIG. 16, at least relative to the lateral maximum boundary of spring 1610 in the state depicted in FIG. 16, so as to accommodate outward/outboard extension of the outer boundary of the spring 1610 upon upward movement of the bridge 1630 upon upward movement of the piezoelectric material 855. That is, in an exemplary embodiment, the bottommost edge of spring 1610 is maintained on the upper surface of the bridge 1630, at least during the expected reasonable translations in the upward direction of the bridge 1630 owing to the various accelerations that may be exposed thereto. That said, in an alternate embodiment, the bridge 1630 is sized as accurately depicted in FIG. 16, at least relative to the spring 1610, and in some embodiments, the outer boundary of the spring 1610 extends past the outer boundaries of the bridge 1630. In this regard, in an exemplary embodiment, the bottom inner surface of the spring 1610 rides on the outer upper edge of the washer 1630 when the washer 1630 is thrust upward when the implantable component 1551 is exposed to a given acceleration and/or deceleration. This exemplary scenario of operation with respect to this exemplary embodiment is schematically depicted in FIG. 18, which also depicts an exemplary embodiment where the bottom spring 920 is different than the top spring 610. In an exemplary embodiment, the upper outer edge of the bridge 1630 can be beveled, curved, chamfered, etc., so as to create a smoother edge for the spring to slide there against. Still further, in an exemplary embodiment, the bridge 1630 can be an assembly that includes a roller component or ball bearing device or the like that interfaces between the spring 1610 and the bridge 1630 so as to further facilitate relative movement between the two components.

Figure 19:
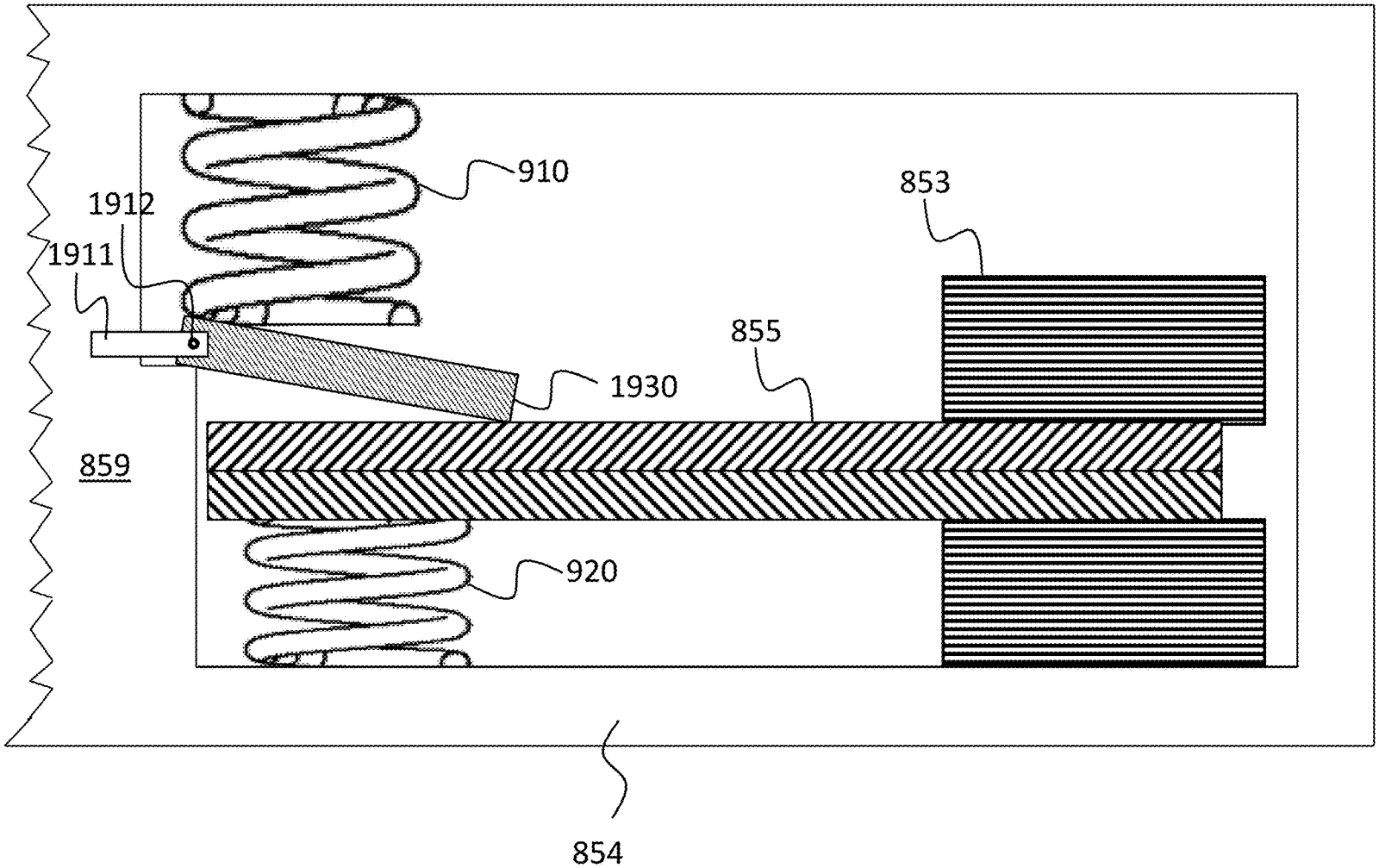

The embodiments detailed above have presented the bridge 930 and 1630 as a single component that extends about the core 859. More particularly, in the exemplary embodiment detailed above, the bridge 930 is circular washer having a hole therethrough that extends about the core 859, but which hole has a diameter that is smaller than the outer diameter of the core 859 below the shoulder 940. FIG. 19 depicts an alternate embodiment where the bridge is not a single component that extends completely about the core 859, but instead is a component that articulates relative to the core 859 and remains at least partially in contact with the piezoelectric component 855, or a wear plate or the like located thereon positioned between the bridge and the piezoelectric material 855. More particularly, FIG. 19 depicts bridge 1930, which is in the form of a plate that extends from the piezoelectric component 855 to the shoulder 940, and is held in place by arm 1911 and pin 1912. In the embodiment of FIG. 19, when the piezoelectric component 855 is moved downward, the pin 1912 holds the bridge 1930 in place while permitting the bridge to articulate thereabout. As can be seen, the bridge 1930 tilts downward to remain in contact with the piezoelectric component 855. By balancing the location of spring contact against the bridge 1930, at least some of the utilitarian value associated with the bridge 930 detailed above can be achieved by this embodiment. For example, it can be seen that the bottom inboard portions of the spring 910 is the only portion that contacts the bridge 1930.

Because this portion is located directly above the outer diameter of the shoulder 940, at least almost all of the spring force is resisted by the shoulder through the bridge 1930. That is, the spring 910 imparts little, if any, force on to the piezoelectric component 855 via bridge 1930 when the bridge 1930 rotates as depicted in FIG. 19.

Figure 20:
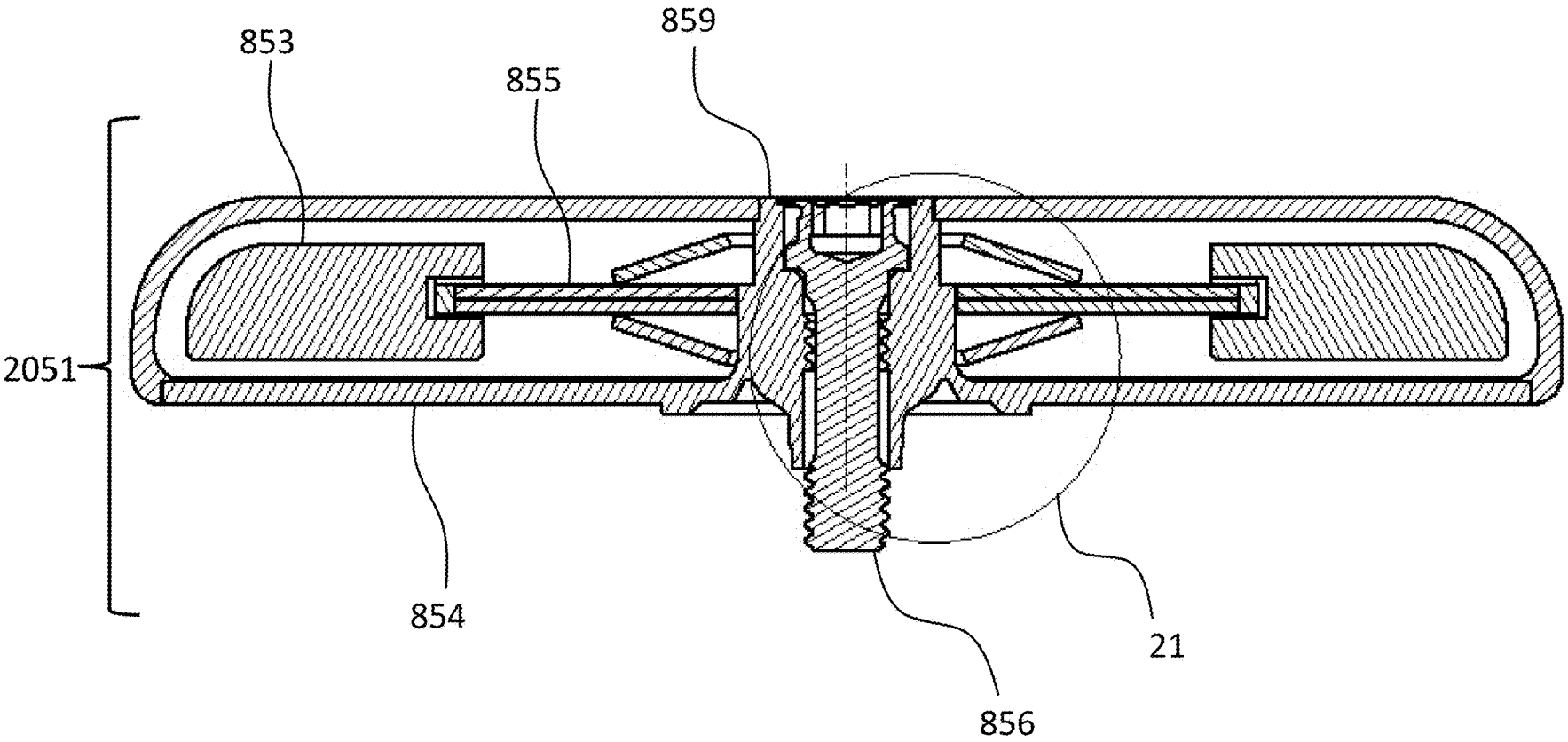
FIGS. 20 and 21 are schematic diagrams depicting an alternate embodiment according to the teachings detailed herein.
Figure 21:
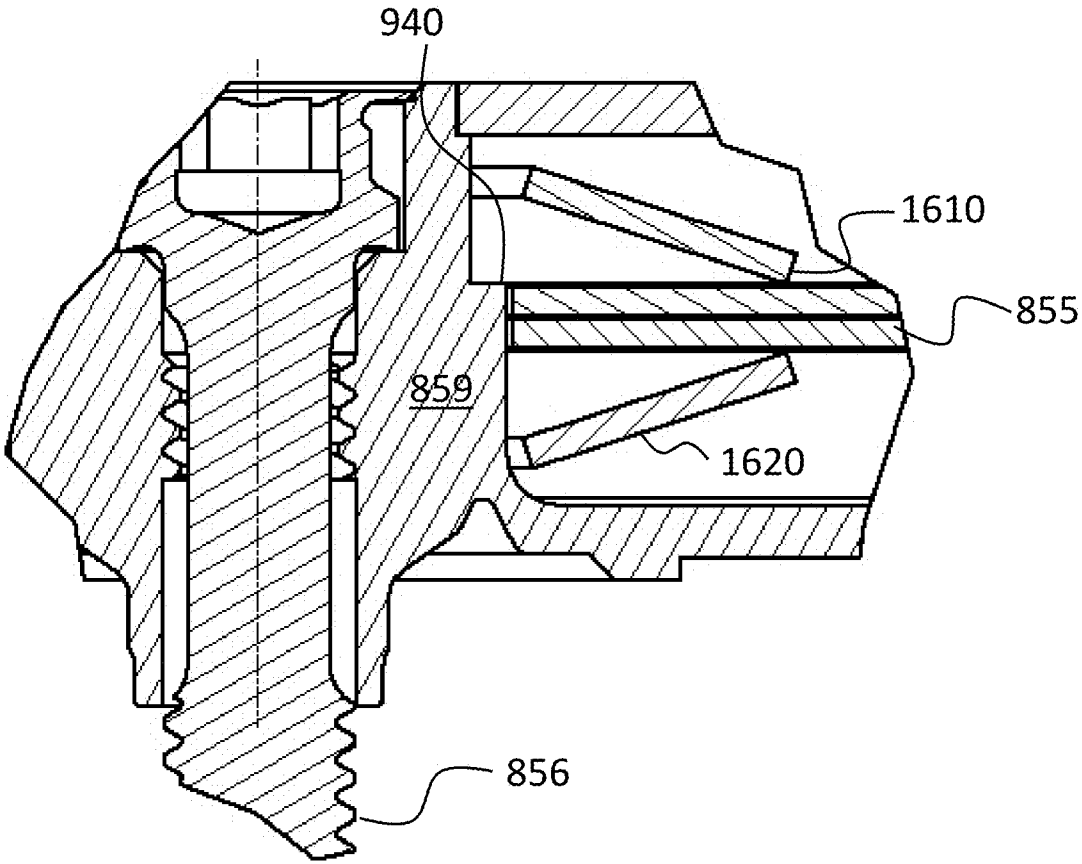

FIGS. 20 and 21 depict an alternate embodiment of an implantable component 2051 which does not utilize a bridge. Instead, springs 1610 and 1620 are both in direct contact with the piezoelectric component 855 (or a wear plate located there between (not shown)). In an exemplary embodiment, the implantable component 2051 is sized and dimensioned such that the piezoelectric component 855 will not become hung up on the shoulder 940 throughout the movements of the piezoelectric component relative to the core 859. That said, in an alternate embodiment, there is no shoulder 940 (because there is no bridge).

In an exemplary embodiment, the piezoelectric bender is springingly clamped within the housing (e.g., as is the case with respect to the embodiment of FIG. 8).

Figure 22:
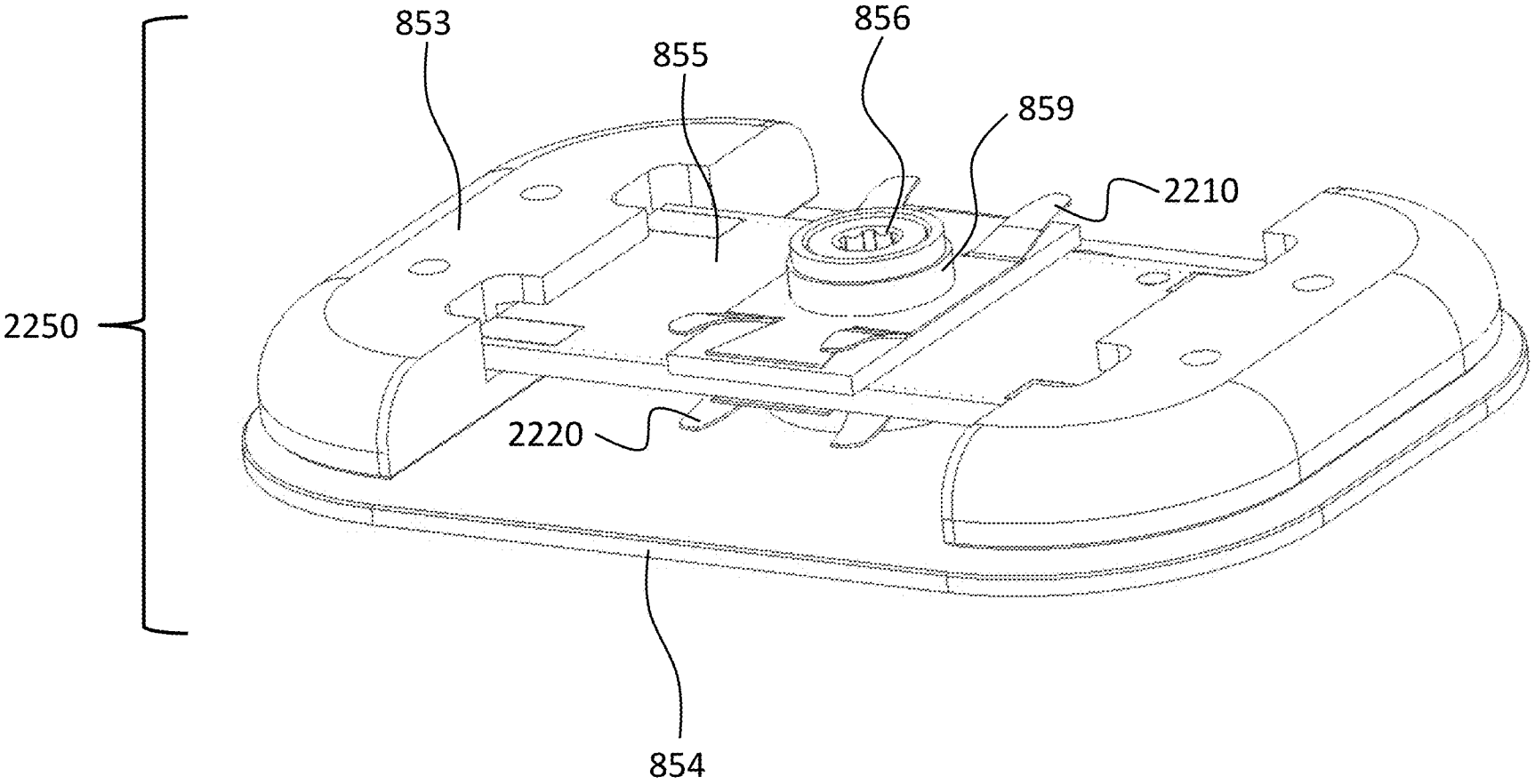
FIGS. 22 and 23 are schematic diagrams depicting an alternative embodiment according to the teachings detailed herein.
Figure 23:
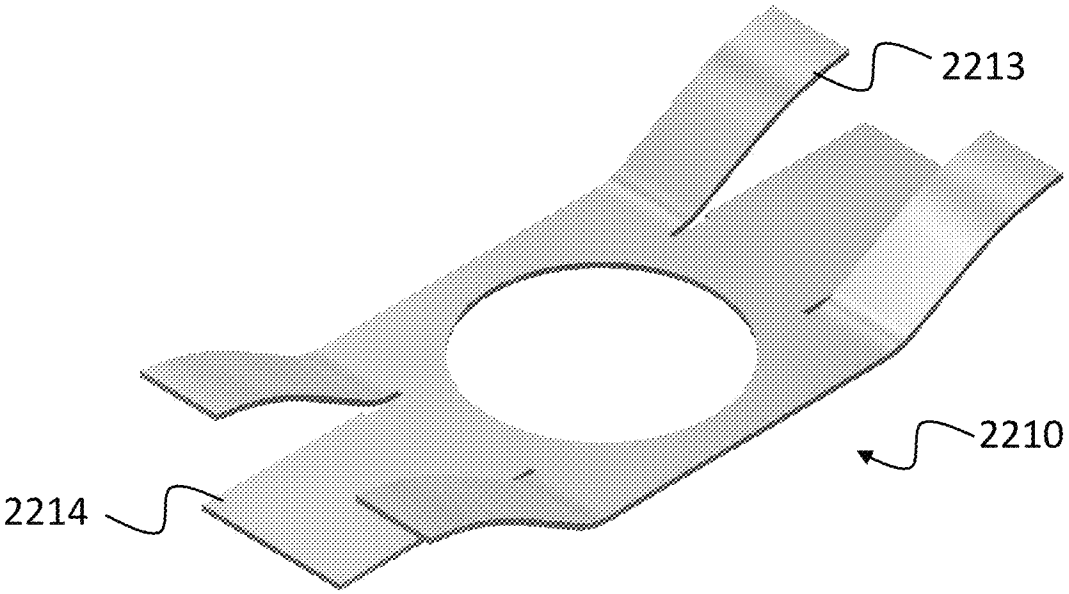

FIG. 22 depicts a portion of an implantable component 2250 of an active transcutaneous bone conduction device, with the outer top housing removed for purposes of clarity, but the bottom housing portion 854 depicted. This exemplary embodiment utilizes a leaf springs 2210 and 2220 instead of coil springs or the beveled springs/conical springs. FIG. 23 depicts an isolated view of spring 2210. As can be seen, leafs 2213 extend above the plane of the leaf 2214, where leaf 2214, in use, is located against the piezoelectric component 855 or against the bridge in embodiments that utilize such (not shown). Leafs 2213 directly or indirectly contact the top portion of the housing. When the transducer-seismic mass is forced upward, leafs 2213 bend towards leafs 2214. In some exemplary embodiments, the contours of the leafs 2213 enable the nonlinear features detailed above. For example, in an exemplary embodiment, the leafs 2213 are curved at the ends such that as the leafs 2213 are bent towards the leafs 2214, the leverage length associated therewith is reduced. That is, instead of the tips of the leafs 2213 being in direct contact with the housing, bearing the load, portions inboard of the tips of the leafs 2213 come into direct contact with the housing, thus bearing the load instead of the portions at the tip and/or in addition to the portions of the tip. Thus, instead of an effective distance from the bend at the base of the leaf 2213 to the contact of the leaf 2213 with the housing being a first length, the effective distance from the bend at the base of the leaf 2213 to the contact of the leaf 2213 with the housing is a second length different than the first length (less than the first length). This changes the effective spring constant k. Here, the spring constant should increase with increased deflection. However, an alternate arrangement can be established, such as by utilizing a contoured housing surface, where with increasing deflection, the contact location between the leafs 2213 and the housing, where the load is borne, move outboard, thus reducing the effective spring constant.

Figure 24:
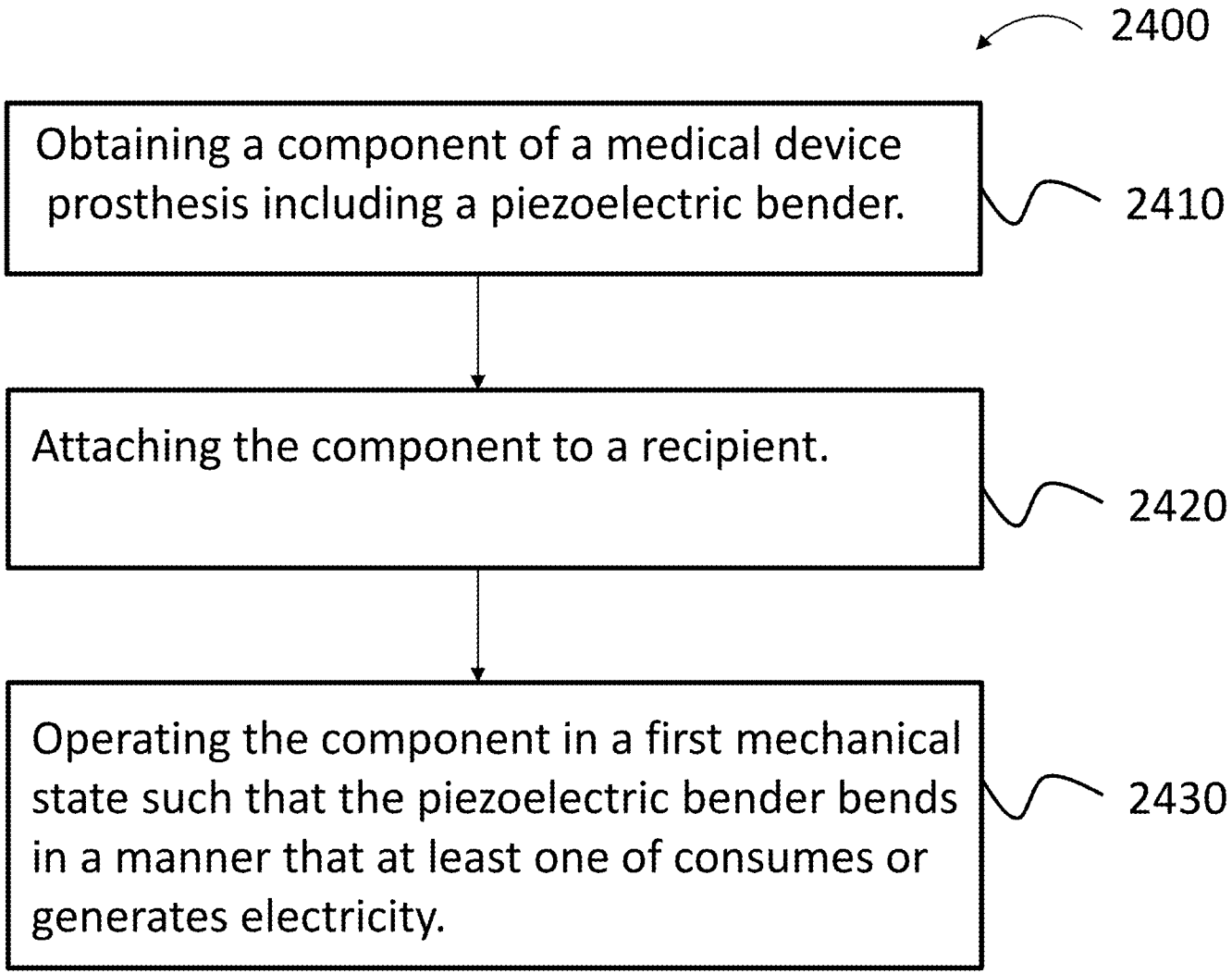
FIG. 24 presents an exemplary flowchart for an exemplary method according to an exemplary embodiment.

FIG. 24 depicts a flowchart for an exemplary method 2400 according to an exemplary embodiment. Method 2400 includes method action 2410, which includes obtaining a component of a medical device prosthesis including a piezoelectric bender. In an exemplary embodiment, this medical device prosthesis can correspond to any of those detailed herein and/or variations thereof. Method 2400 further includes method action 2420 (it is noted that in some embodiments, method action 2420 is not part of method 2400), which includes attaching the component to a recipient. This can be done via a surgical procedure in the case of an active transcutaneous bone conduction device. This can also be done without such a surgical procedure, such as is the case with respect to a passive transcutaneous bone conduction device and/or a percutaneous bone conduction device (although a surgical procedure may be required to implant the abutment to the bone). Method 2400 further includes method action 2430, which includes operating the component in a first mechanical state such that the piezoelectric bender bends in a manner that at least one of consumes or generates electricity. In an exemplary embodiment of method 2400, the component is configured to experience an acceleration of 100 Gs in the first mechanical state in both directions normal to a plane of extension of the piezoelectric bender (parallel to the longitudinal axis of the component of FIG. 8, for example) and subsequently operate in the first mechanical state.

In an exemplary embodiment of method 2400, the piezoelectric bender floats in its entirety within the housing. Further, in an exemplary embodiment, the method 2400 is further executed with the action of operating the component in the first mechanical state with the piezoelectric bender floating in its entirety within the housing. Still further, in an exemplary embodiment of method 2400, the piezoelectric bender is at least indirectly sandwiched between at least two springs (in some embodiments, the bender is directly sandwiched between the two springs) while the component is in the first mechanical state, the at least two springs collectively applying a compressive force onto the piezoelectric bender. In some examples, the at least two springs are compressible in opposite directions to enable the piezoelectric bender to move within the housing, in its entirety, in the respective direction of compression.

Still further, in at least some exemplary embodiments of method 2400, the piezoelectric bender utilized to execute method 2400 encompasses a core of a housing of the medical device in which the piezoelectric bender is located, and the piezoelectric bender is slidably retained to the core when in the first mechanical state. Consistent with the teachings detailed above vis-a-vis the active and/or passive transcutaneous bone conduction device and/or the percutaneous bone conduction device, in an exemplary embodiment, the component that is utilized in method 2400 is a bone conduction device. The bone conduction device includes at least one seismic mass supported in its entirety by the piezoelectric bender. Still further, the component utilized to execute method 2400 is configured such that the seismic mass moves a distance that is at least ABCD times a distance greater than the distance (e.g., maximum distance) that the seismic mass moves from a rest position when energized with maximum electrical current and voltage producible by the component when subjected to XYZ Gs. In an exemplary embodiment, ABCD is 5, 6, 7, 8, 9, 10, 11, 12, 13, 14, 15, 16, 17, 18, 19, 20, 21, 22, 23, 24, 25, 30, 35, 40, 45, 50, 55, 60, 65, 70, 75, 80, 85, 90, 95, 100, 125, 150, 175, 200, 250, 300, 350, 400, 450, 500, 550, 600, 700, 800, 900, 1000, 1250, 1500, 1750, 2000, 2500, 3000, 3500, 4000, 4500, 5000, or more, or any value or range of values therebetween in 1 increment, and XYZ is 10, 15, 20, 25, 30, 35, 40, 45, 50, 60, 70, 80, 90, 100, 110, 120, 130, 140, 150, 175, 200, 225, 250, 275, 300, 350, 400, 450, 500, or more Gs, or any value or range of values therebetween in 1 G increments. In an exemplary embodiment, the aforementioned movement associated with this feature of method 2400 can correspond to the change in D1 discussed above.

That is, for example, if ABCD is 10, and XYZ is 100 G, movement of the seismic mass can reduce the dimension D1 by, for example, a first unit value, and method 2400 is such that in the 100 G environment, movement of the seismic mass is ten times that first unit value (e.g., D1 is reduced by ten times the about that D1 is reduced with respect to the first unit).

As noted above, the component of method 2400 can be an implantable portion of an active transcutaneous bone conduction device, and the method further comprises the action of subjecting the component to an acceleration of at least 100 Gs, wherein the action of attaching the component to a recipient includes implanting the component in the recipient after subjecting the component to an acceleration of at least XYZ Gs.

Figure 25:
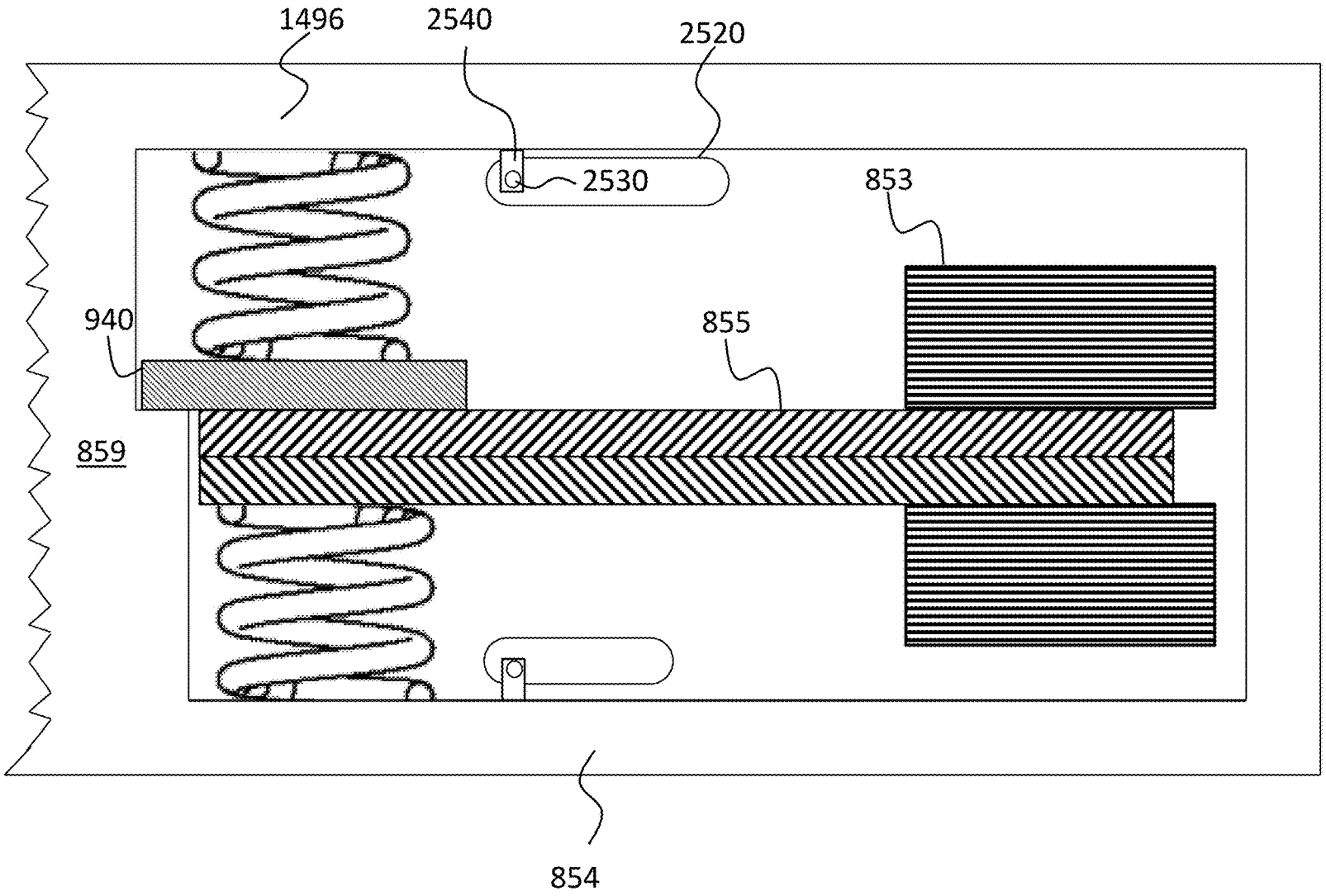
FIGS. 25 and 26 are schematic diagrams of alternative embodiments according to an exemplary embodiment.
Figure 26:
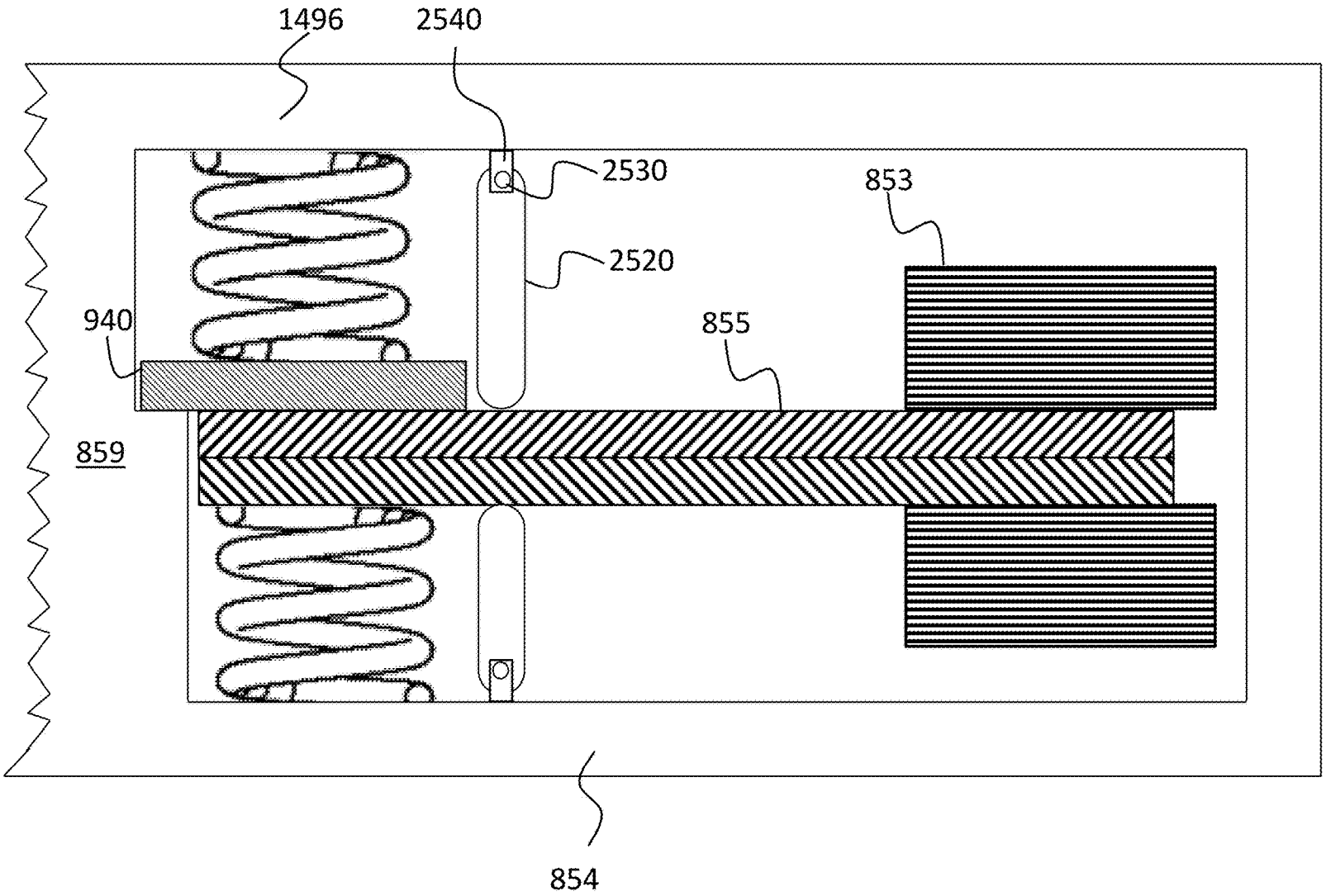

FIGS. 25 and 26 depict an exemplary embodiment in which the ability of the piezoelectric component 855 to translate relative to the housing can be alternatively engaged and disengaged. In this exemplary embodiment, the implantable component (or other applicable component) includes levers 2520 that are hinged to bracket 2540 via pin 2530. In an exemplary embodiment, prior to implantation and/or interfacing of the prosthetic component with a recipient, or even after such interfacing, levers 2520 are maintained in the "stowed" position as seen in FIG. 25. In this regard, the piezoelectric component 855 can translate according to the teachings detailed herein vis-à-vis the compression of the springs. Conversely, when the levers 2520 are placed into the un-stowed position, as seen in FIG. 26, the piezoelectric component 855 cannot translate according to the teachings detailed herein (or, more specifically, the entire piezoelectric component 855 cannot translate). The embodiment of FIGS. 25 and 26 is configured such that the levers 2520 clamp the piezoelectric component therebetween, such that the result is analogous to the results of a traditional piezoelectric transducer that is clamped, such as, to the core 859. That is, the piezoelectric transducer, in the bender form here, can bend up words and/or downwards when supplied with an electrical current, etc., at locations outboard of the levers 2520, with the locations at the levers 2520 not moving.

In an exemplary embodiment of use, prior to, during, and/or subsequent to implantation and/or attachment and/or interfacing of the component with the recipient, the levers 2520 are un-stowed. Such can have utilitarian value with respect to eliminating any damping and/or any signal losses associated with supporting the piezoelectric component 855 via the springs. That is, in at least some instances, the output of the piezoelectric component 855 with respect to outputting vibrations to evoke a hearing percept might be less than that which would otherwise be the case in the absence of the springs and in the presence of a rigid clamping system. This could also be the case in some instances even where the bridge 930 is utilized. By utilizing the levers 2520 to clamp the piezoelectric component 855, at least some of this loss is reduced.

Accordingly, in at least some exemplary embodiments, the configurations of FIGS. 25 and 26 can have utilitarian value with respect to providing the shock proofing detailed herein during transportation of the component and/or during storage of the component and/or during handling of the component prior to interfacing with the recipient and/or even after interfacing with the recipient, while also permitting the performance characteristics of the component to be improved by eliminating or otherwise disabling the shock proofing during a period when the component is utilized. In an exemplary embodiment, the component is configured such that upon the tightening of the screw 856 into a bone fixture during implantation, a portion of the housing expand slightly so as to un-stow the levers 2520. For example, in an exemplary embodiment, prior to tightening of the screw 856, the component is in the configuration of FIG. 25. While the screw is being tightened, a portion of the housing could expand or otherwise buckle in an acceptable manner such that retaining components that retain the levers 2520 in the stowed position move so as to permit the levers to move to their un-stowed position. In an exemplary embodiment, the levers 2520 can be spring loaded.

Also, in an exemplary embodiment, there is a removable component, such as a percutaneous bone conduction device removable component (sometimes referred to as the sound processor) or a passive transcutaneous bone conduction device removable component (also sometimes referred to as the sound processor) configured such that levers 2520 or any other embodiment having an equivalent functionality thereof are automatically placed in the stowed position upon the removal of the removable component from contact and/or attachment with the recipient. By way of example only and not by way of limitation, in an exemplary embodiment, while the removable component is attached or otherwise interfacing with the recipient, levers 2520 are in the un-stowed position as seen in FIG. 26, at least during a portion of that period of time. However, in an exemplary embodiment, the removable component is configured such that upon the recipient removing the removable component from the recipient (e.g., from the abutment in the case of a percutaneous bone conduction device, and from direct contact with the skin in the case of a transcutaneous bone conduction device), the levers 2520 automatically revert to the stowed position as seen in FIG. 25. Thus, upon removal of the removable component from the recipient, the shock proofing is automatically enabled.

In an exemplary embodiment, a sensor can be provided as part of the removable component that detects whether or not the removable component is attached to the recipient. In an exemplary embodiment, such as by way of example only and not by way of limitation, with respect to the transcutaneous bone conduction device where the removable component is held to the skin via magnetic attraction with an implantable component, the sensor can sense a change in the magnetic field that holds the removable component against the skin of the recipient that results in the removable component being moved away from the skin of the recipient, and thus away from the magnet implanted in the recipient, and upon such sensing, a control system of the removable component (e.g., a microprocessor or the like) can activate actuators to automatically stow the levers 2520. In an exemplary embodiment, the automatic system can be mechanical. By way of example only and not by way limitation, a linkage assembly of the removable component can be configured such that upon the removable component being removed from the abutment, and thus the snap coupling teeth of the removable component move so as to release the removable component from the abutment, and this movement of the teeth can be transferred via the linkage to the levers 2520 to place them in the stowed position of FIG. 25. Alternatively, a pressure sensor or the like can be utilized to sense the movements of the teeth, and the pressure sensor can provide a signal to electromagnetic actuator the like to move the levers 2520 to the stowed position.

Any arrangement that can enable the automatic stowing of the levers 2520 or any other equivalent system to enable or otherwise more fully engage the shock proofing system can utilize in at least some exemplary embodiments. Any arrangement that can enable the detection and/or sensing of the removal of the removable component from the recipient so as to implement automatic stowing can be utilized at least some exemplary embodiments.

Note further that in an exemplary embodiment, a feedback system or the like can be utilized to determine whether or not the prosthesis is attached to or otherwise connected to a recipient. In this regard, in an exemplary embodiment, a resident frequency of the system can change upon the removable component being removed from the recipient. Thus, in an exemplary embodiment, an onboard microprocessor or the like can be utilized to sense a change in the resident frequency, and thus automatically move the levers to the stowed position by outputting a signal to an actuator or the like that moves the levers. Note also that in at least some exemplary embodiments of the automated system is a system that is configured to automatically activate if the removable component falls off the recipient (e.g., unintentional removal). Thus, in an exemplary embodiment, the teachings detailed herein with respect to the automatic stowing of the levers can be implemented in the event of an accidental "dropping" of the external component, which could otherwise damaged the external component.

Note also that some exemplary embodiments can be applicable to a transcutaneous bone conduction device that is in the form of a BTE component, where, for example, there is no magnetic field that holds the vibrator in place against the skin of the recipient. Again, in an exemplary embodiment, a feedback regime can be utilized to determine or otherwise estimate that the removable component has been removed from the recipient. Still further, pressure sensor can be utilized that determines that the BTE device or any other device for that matter has been removed from skin of the recipient. With respect to the BTE device, in an exemplary embodiment, the pressure sensor can be located on the arch of the BTE device on the inside thereof facing the top of the pinna (the point where the pinna merges with the skin covering the skull). The weights of the BTE device thus activates the pressure sensor due to the contact of the BTE device with the top of the pinna. Upon the removal of the BTE device from the pinna, the pressure generated by the skin and the weight of the BTE device is thus reduced and/or eliminated. This activates the pressure sensor or otherwise output a signal to a microprocessor or the like that analyzes the signal and determines that the reading is indicative of a reduction and/or elimination in the pressure, and thus the microprocessor outputs a signal to the levers 2520 to place the levers in the stowed position to thus enable the shock proofing.

That said, in an alternate embodiment, the component is configured to permit the levers to be stowed and un-stowed after implantation and/or after/during interfacing with the recipient. By way of example only and not by way of limitation, in an exemplary scenario, a recipient may experience scenarios of use where the component is more likely to experience the accelerations detailed herein that can have a deleterious effect on the piezoelectric component 855 then that which might otherwise be the case. In such instances, the recipient may find that when the shock proofing is engaged, which could result by re-stowing the levers 2520, the signal loss/the vibrational output losses associated with the shock proofing is acceptable at least for limited periods of time, at least relative to the utilitarian value of having the component shockproof during those periods. Accordingly, in an exemplary scenario, where the component is an implantable component of an active transcutaneous bone conduction device, where the recipient engages in full contact American football, the recipient could re-stow the levers 2520 to engage the shock proofing. After completing the football game, the recipient could then again un-stow the levers to disengage the shock proofing.

In an exemplary embodiment, the levers can be stowed and un-stowed via the utilization of a magnetic field or the like. For example, the recipient could place a magnet against his or her head proximate the implanted component, with a magnetic field moves the levers from the stowed position to the un-stowed position and/or vice versa, to engage and/or disengage the shock proofing. Alternatively, and/or in addition to this, in an exemplary embodiment, actuators can be located on the levers 2520. In some exemplary embodiments, a signal can be provided to these actuators (the signal can be provided through the feedthrough or the like that enables the electrical signals to be fed into the housing and to the piezoelectric component 855 so as to actuate the piezoelectric component 855) to actuate the actuator to move the levers. Indeed, in an exemplary embodiment, the signal can be interleaved with the signals that are provided to the piezoelectric component 855 to cause the piezoelectric component to actuate. Alternatively and/or in addition to this, the housing can be flexible or the like so that the housing can be pushed on to stow the levers and then pushed on again to un-stow the levers. Any arrangement that can enable the stowing and/or the un-stowing of the levers can be utilized in at least some exemplary embodiments.

While levers have been depicted in the embodiment of FIGS. 25 and 26, other types of components can be utilized, such as by way of example only and not by way of limitation, expanding and retracting actuators, movable balls, etc. Still further, in an exemplary embodiment, the springs can be configured so as to increase and/or decrease stiffness. Any arrangement that can enable the controlled enabling and/or disabling of the shock proofing can be utilized in at least some exemplary embodiments.

In view of the above, in an exemplary embodiment, there is a medical device as detailed above and/or below, wherein the medical device is configured to controllably at least partially limit the functionality of the at least one spring relative to that which was the case prior to the at least partially limiting of the functionality of the spring. It is noted that while the embodiments of FIGS. 25 and 26 essentially completely limit the functionality of the springs, in some alternate embodiments, the component can be configured so as to simply provide a more rigid system/mitigate or otherwise reduce any vibrational loss is due to the springs.

It is noted that the locking mechanism detailed above can be applied or otherwise activated and/or deactivated when the housing is closed (e.g., as is the case when the component containing the transducer is an operational state). In an exemplary embodiment, the locking mechanism detailed above can be applied or otherwise activated and/or deactivated when the housing is hermetically sealed. It is also noted that any of the teachings detailed herein and/or variations thereof can be applicable to the case where the housing is closed and/or hermetically sealed.

In an exemplary embodiment, there is a prosthetic medical device, comprising a housing; and a piezoelectric component, wherein the piezoelectric component is supported in the housing via at least one spring. In an exemplary embodiment, there is a medical device as described above and/or below, wherein the device is configured to controllably at least partially limit the functionality of the at least one spring relative to that which was the case prior to the at least partially limiting of the functionality of the spring. In an exemplary embodiment, there is a bone conduction device, comprising: a housing; and a transducer-seismic mass assembly including a piezoelectric component, wherein the transducer-seismic mass assembly of the bone conduction device is configured to translate in its entirety within the housing when the housing is closed. In an exemplary embodiment, there is a bone conduction device as described above and/or below, wherein the first spring is configured to compress with increasing resistance to compression within a range of first spring constants when the spring is compressed a first percentage range and the first spring is configured to compress with decreasing resistance to compression within a range of second spring constants when the spring is compressed a second percentage range larger than the first percentage range and adjacent to the first compression range. In an exemplary embodiment, there is a bone conduction device as described above and/or below, wherein the component is configured to prevent the transducer-seismic mass assembly from translating in its entirety subsequent to the ability to translate in its entirety.

It is noted that any disclosure of a device and/or system herein corresponds to a disclosure of a method of utilizing such device and/or system. It is further noted that any disclosure of a device and/or system herein corresponds to a disclosure of a method of manufacturing such device and/or system. It is further noted that any disclosure of a method action detailed herein corresponds to a disclosure of a device and/or system for executing that method action/a device and/or system having such functionality corresponding to the method action. It is also noted that any disclosure of a functionality of a device herein corresponds to a method including a method action corresponding to such functionality. Also, any disclosure of any manufacturing methods detailed herein corresponds to a disclosure of a device and/or system resulting from such manufacturing methods and/or a disclosure of a method of utilizing the resulting device and/or system.

Unless otherwise specified or otherwise not enabled by the art, any one or more teachings detailed herein with respect to one embodiment can be combined with one or more teachings of any other teaching detailed herein with respect to other embodiments.

While various embodiments have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A prosthetic medical device, comprising:
a housing; and
a piezoelectric component, wherein
the piezoelectric component is supported in the housing via at least one spring.

2. The medical device of claim 1, wherein:
the at least one spring is a leaf spring.

3. The medical device of claim 1, wherein:
the piezoelectric component is directly supported in the housing by the at least one spring.

4. The medical device of claim 1, wherein the medical device is configured to permit a seismic mass supported by the piezoelectric component to strike a housing wall.

5. The medical device of claim 1, wherein:
the medical device has a core component about which the piezoelectric component extends, and wherein the piezoelectric component is configured to move along a longitudinal axis of the core as a result of compression of the at least one spring.

6. The medical device of claim 5, wherein:
the medical device is a bone conduction device;
the piezoelectric component is configured to vibrate in response to a captured sound; and
the medical device is configured such that at least some of the vibrations generated by the piezoelectric component travel from the piezoelectric component to the core via a vibration bridge.

7. The medical device of claim 1, wherein:
the piezoelectric component is supported within the housing by at least two separate springs, both of which are in compression, corresponding to the at least one spring.

8. The medical device of claim 1, wherein:
the prosthetic medical device is configured to enable permanent shock-proofing of the piezoelectric component beyond that which results from damping.

9. A component of a bone conduction device, comprising:
a housing; and
a transducer-seismic mass assembly, wherein
the component is configured to enable permanent shock-proofing of the assembly beyond that which results from damping, and
the permanent shock-proofing is a result of the component being configured to automatically at least partially decouple a vibratory path extending from the transducer-seismic mass assembly to the housing upon the housing experiencing a G force above a certain level.

10. The component of claim 9, wherein:
the component is configured to automatically reestablish the vibratory path extending from the transducer-seismic mass assembly to the housing upon the housing being relieved from exposure of the G force above the certain level.

11. The component of claim 9, wherein:
the transducer-seismic mass assembly includes a piezoelectric bender and one or more counterweights located at ends of the piezoelectric bender;
the component is configured to apply an electrical current to the piezoelectric bender to cause the piezoelectric bender to bend in a vibratory manner, thereby moving the one or more counterweights towards and away from a surface of the housing in a vibratory manner; and
the piezoelectric bender is springingly clamped within the housing.

12. The component of the bone conduction device of claim 9, wherein:
the housing is completely implanted in a recipient underneath skin of the recipient.

13. A component of a bone conduction device, comprising:
a housing; and
a transducer-seismic mass assembly, wherein
the component is configured to enable permanent shock-proofing of the assembly beyond that which results from damping,
the transducer-seismic mass assembly includes a counterweight, and
the permanent shock-proofing is a result of the component being configured to enable the counterweight to strike an interior of the housing upon subjecting the housing to a G force that would otherwise break the transducer-seismic mass assembly in the absence of the shock-proofing.

14. The component of claim 13, wherein:

the transducer-seismic mass assembly includes a piezoelectric bender;

the component is configured to apply an electrical current to the piezoelectric bender to cause the piezoelectric bender to bend in a vibratory manner, thereby moving the counterweight, which is attached to the piezoelectric bender, towards and away from a surface of the housing in a vibratory manner;

the piezoelectric bender is non-rigidly connected to the housing; and the component is configured such that vibrations from the piezoelectric bender travel therefrom to the housing to evoke a hearing percept.

15. The component of claim 13, wherein:

the transducer-seismic mass assembly includes a piezoelectric bender that surrounds a core of the housing; and the component is configured such that portions of the piezoelectric bender that are directly adjacent the core move in a direction parallel to a longitudinal axis of the core when the piezoelectric bender is subjected to a force greater than ten Newtons in a direction parallel to the longitudinal direction, thereby permanently shock-proofing the assembly.

16. A bone conduction device, comprising:

a housing; and a transducer-seismic mass assembly including a piezoelectric component, wherein the transducer-seismic mass assembly of the bone conduction device is configured to translate in its entirety within the housing when the housing is closed.

17. The component of claim 16, wherein:

the transducer-seismic mass assembly is supported within the housing by at least two separate springs, both of which are in compression.

18. The component of claim 16, wherein:

the transducer-seismic mass assembly is in vibrational communication with the housing via a vibration bridge extending from the transducer-seismic mass assembly to the housing and in contact with both the transducer-seismic mass and the housing, wherein the vibration bridge is not secured to the housing or the transducer-seismic mass.

19. The component of claim 16, wherein:

the transducer-seismic mass assembly is in vibrational communication with the housing via a vibration bridge extending from the transducer-seismic mass assembly to the housing;

the component is configured to force the vibration bridge into full contact with the transducer-seismic mass and vis-a-versa when the transducer-seismic mass is actuated to evoke a bone conduction hearing when subject to less than a 10 G environment; and the component is configured to enable the transducer-seismic mass to move away from a substantial portion of the vibration bridge when the transducer-seismic mass is subject to an acceleration greater than 20G in a first direction.

20. The component of claim 19, wherein:

the component is configured such that the vibration bridge is held against the transducer-seismic mass assembly when the transducer-seismic mass is subject to an acceleration greater than 20G in a second direction opposite the first direction.

21. The component of claim 16, wherein:

the transducer-seismic mass assembly is at least indirectly sandwiched between a first spring under a first compression force and a second spring under a second compression force on an opposite side of the transducer-seismic mass assembly from the first spring;

the transducer-seismic mass assembly is configured to translate in the direction of the first spring upon the transducer-seismic mass assembly applying a force against the first spring greater than the first force; and the transducer-seismic mass assembly is configured to translate in the direction of the second spring upon the transducer-seismic mass applying a force against the second spring greater than the second force.

22. The component of claim 21, wherein:

the transducer-seismic mass assembly is configured to only translate in the direction of the first spring upon the transducer-seismic mass assembly applying a force against the first spring greater than 1.25 times the first force; and the transducer-seismic mass assembly is configured to only translate in the direction of the second spring upon the transducer-seismic mass applying a force against the second spring greater than 1.25 times the second force.

23. The component of claim 21, wherein:

the first compression force is greater than the second compression force when the entirety of the transducer-seismic mass is static relative to the housing.

24. The component of claim 16, wherein:

the transducer-seismic mass assembly is configured to translate in its entirety within the housing when the housing is stationary relative to tissue of a recipient.

25. A method, comprising:

obtaining a component of a medical device prosthesis including a piezoelectric bender; and operating the component in a first mechanical state such that the piezoelectric bender bends in a manner that at least one of consumes or generates electricity, wherein the component is configured to experience an acceleration of 30Gs in the first mechanical state in both directions normal to a plane of extension of the piezoelectric bender and subsequently operate in the first mechanical state, the piezoelectric bender floats in its entirety within a housing, and the method includes operating the component in the first mechanical state with the piezoelectric bender floating in its entirety within the housing.

26. The method of claim 25, wherein:

the component is an implantable portion of an active transcutaneous bone conduction device; and the method further comprises:

subjecting the component to an acceleration of at least 100Gs, wherein the action of attaching the component to a recipient includes implanting the component in the recipient after subjecting the component to an acceleration of at least 100Gs.

27. A method, comprising:

obtaining a component of a medical device prosthesis including a piezoelectric bender; and operating the component in a first mechanical state such that the piezoelectric bender bends in a manner that at least one of consumes or generates electricity, wherein the component is configured to experience an acceleration of 30Gs in the first mechanical state in both directions normal to a plane of extension of the piezoelectric bender and subsequently operate in the first mechanical state, and the piezoelectric bender is at least indirectly sandwiched between at least two springs while the component is in the first mechanical state, the at least two springs collectively applying a compressive force onto the piezoelectric bender, wherein the at least two springs are compressible in opposite directions to enable the piezoelectric bender to move within a housing, in its entirety, in the respective direction of compression.

28. The method of claim 27, wherein:

the component is a bone conduction device;

at least one seismic mass is supported in its entirety by the piezoelectric bender; and the component is configured such that the seismic mass moves a distance that is at least 10 times greater than the distance that the seismic mass moves from a rest position when energized with maximum electrical current and voltage producible by the component when subjected to 100Gs.

29. The method of claim 27, wherein:

the component is a bone conduction device;

at least one seismic mass is supported in its entirety by the piezoelectric bender; and the component is configured such that the seismic mass moves a distance that is at least 50 times greater than the distance that the seismic mass moves from a rest position when energized with maximum electrical current and voltage producible by the component when subjected to 100Gs.

30. A method, comprising:

obtaining a component of a medical device prosthesis including a piezoelectric bender; and operating the component in a first mechanical state such that the piezoelectric bender bends in a manner that at least one of consumes or generates electricity, wherein the component is configured to experience an acceleration of 30Gs in the first mechanical state in both directions normal to a plane of extension of the piezoelectric bender and subsequently operate in the first mechanical state, the piezoelectric bender encompasses a core of a housing of the medical device in which the piezoelectric bender is located, and the piezoelectric bender is slidably retained to the core when in the first mechanical state.

31. A component of a bone conduction device, comprising:

a housing; and a transducer-seismic mass assembly, wherein the component is configured to enable permanent shock-proofing of the assembly beyond that which results from damping, and the transducer-seismic mass assembly includes a piezoelectric component as the transducer, and the enablement of permanent shock-proofing of the assembly beyond that which results from damping is also beyond that which would result from portions of the transducer-seismic mass assembly being stopped by contact, direct or otherwise, by the housing, due to bending of the piezoelectric component.

* * * * *